US011401848B2

(12) United States Patent
Drees et al.

(10) Patent No.: US 11,401,848 B2
(45) Date of Patent: Aug. 2, 2022

(54) EXHAUST FLAP FOR AN EXHAUST SYSTEM OF A MOTOR VEHICLE, CONTROLLER FOR SUCH AN EXHAUST FLAP, AND METHOD FOR OPERATING SUCH AN EXHAUST FLAP

(71) Applicant: Bayerische Motoren Werke Aktiengesellschaft, Munich (DE)

(72) Inventors: Rainer Drees, Munich (DE); Mario Zschiegner, Unterschleissheim (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 271 days.

(21) Appl. No.: 16/657,616

(22) Filed: Oct. 18, 2019

(65) Prior Publication Data

US 2020/0049040 A1 Feb. 13, 2020

Related U.S. Application Data

(63) Continuation of application No. PCT/EP2018/059704, filed on Apr. 17, 2018.

(30) Foreign Application Priority Data

Apr. 20, 2017 (DE) ..... 10 2017 206 642.3

(51) Int. Cl.
*F02D 9/04* (2006.01)
*F01N 1/16* (2006.01)
(Continued)

(52) U.S. Cl.
CPC ..... *F01N 1/168* (2013.01); *F01N 9/00* (2013.01); *F02D 9/04* (2013.01); *F02D 9/10* (2013.01);
(Continued)

(58) Field of Classification Search
CPC ..... F01N 1/165; F01N 1/163; F01N 1/168; F02D 9/10
See application file for complete search history.

(56) References Cited

U.S. PATENT DOCUMENTS 10,525,982 B2 * 1/2020 Suntharalingam ..... B60W 50/0205
2009/0217668 A1 * 9/2009 Venghaus ..... F01N 1/18 60/694
(Continued)

FOREIGN PATENT DOCUMENTS

CN 105074172 A 11/2015
CN 105697114 A 6/2016
(Continued)

OTHER PUBLICATIONS

PCT/EP2018/059704, International Search Report dated Jul. 20, 2018 (Three (3) pages).
(Continued)

*Primary Examiner* — Ngoc T Nguyen
(74) *Attorney, Agent, or Firm* — Crowell & Moring LLP

(57) ABSTRACT

An exhaust flap for an exhaust system of a motor vehicle, which has an internal combustion engine and an electronic processing device for a closed-loop control of the internal combustion engine, has a valve element, an actuator for moving the valve element, and a dedicated electronic processing device. The dedicated electronic processing device is configured to receive a first signal which is provided by the electronic processing device of the motor vehicle and which characterizes a first position of the valve element, generate a second signal which characterizes a second position of the valve element as a function of the received first signal, and transmit the second signal to the actuator.
(Continued)

The actuator moves the valve element into the second position based on the received second signal.

11 Claims, 6 Drawing Sheets

(51) Int. Cl.
*F01N 9/00* (2006.01)
*F02D 9/10* (2006.01)

(52) U.S. Cl.
CPC ..... *F01N 1/165* (2013.01); *F01N 2900/08* (2013.01); *F01N 2900/1411* (2013.01); *F02D 2200/101* (2013.01); *F02D 2200/1002* (2013.01); *F02D 2200/602* (2013.01); *F02D 2200/604* (2013.01)

(56) References Cited

U.S. PATENT DOCUMENTS

| | | | | |
|---|---|---|---|---|
| 2012/0180465 | A1* | 7/2012 | Takagaki | F01N 1/02 60/324 |
| 2012/0226426 | A1 | 9/2012 | Finn et al. | |
| 2012/0253641 | A1 | 10/2012 | Warner et al. | |
| 2016/0123210 | A1 | 5/2016 | Dmytrow et al. | |
| 2016/0273424 | A1* | 9/2016 | Han | F01N 1/083 |
| 2017/0234265 | A1* | 8/2017 | Zhou | F01N 1/163 60/615 |
| 2018/0223709 | A1* | 8/2018 | Pietila | F01N 1/168 |
| 2018/0238208 | A1* | 8/2018 | Saxman | F01N 1/163 |
| 2019/0186385 | A1* | 6/2019 | Shimane | F02D 9/00 |

FOREIGN PATENT DOCUMENTS

| | | | |
|---|---|---|---|
| DE | 295 00 928 | U1 | 5/1995 |
| DE | 20 2005 001 197 | U1 | 6/2005 |
| DE | 10 2005 054 991 | A1 | 5/2007 |
| DE | 10 2007 053 211 | A1 | 5/2009 |
| DE | 10 2013 208 946 | A1 | 11/2014 |
| DE | 10 2016 207 002 | A1 | 10/2017 |
| WO | WO 2009/115845 | A1 | 9/2009 |
| WO | WO 2010/103288 | A1 | 9/2010 |
| WO | WO 2010/125396 | A1 | 11/2010 |

OTHER PUBLICATIONS

German Search Report issued in German counterpart application No. 10 2017 206 642.3 dated Sep. 25, 2017, with Statement of Relevancy (Six (6) pages).

United Nations / Economic Commission for Europe: Regulation No. 51—Uniform provisions concerning the approval of motor vehicles having at least four wheels with regard to their sound emissions. Addendum 50, Revision 3 (E/ECE/324/Rev. 1/Add.50/Rev.3/Amend.1-E/ECE/TRANS/505/Rev.1/Add.50/Rev.3/Amend.1). Oct. 8, 2016, URL: http://www.sneca.org/fileadmin/DAM/trans/main/wp29/wp29regs/2016/R051r3am1e.pdf Two (2) total pages.

United Nations / Economic Commission for Europe: Regulation No. 51—Uniform provisions concerning the approval of motor vehicles having at least four wheels with regard to their sound emissions. Addendum 50, Revision 3 (E/ECE/324/Rev. 1/Add.50/Rev.3-E/ECE/TRANS/505/Rev.1/Add.50/Rev.3). Jan. 20, 2016, URL: http://www.uneca.org/fileadmin/DAM/trans/main/wp29/wp29regs/2016/R051r3e.pdf Seventy (75) total pages.

Chinese Office Action issued in Chinese application No. 201880016324.0 dated Jun. 23, 2021, with English translation (Twenty (20) pages).

* cited by examiner

EXHAUST FLAP FOR AN EXHAUST SYSTEM OF A MOTOR VEHICLE, CONTROLLER FOR SUCH AN EXHAUST FLAP, AND METHOD FOR OPERATING SUCH AN EXHAUST FLAP

CROSS REFERENCE TO RELATED APPLICATIONS

This application is a continuation of PCT International Application No. PCT/EP2018/059704, filed Apr. 17, 2018, which claims priority under 35 U.S.C. § 119 from German Patent Application No. 10 2017 206 642.3, filed Apr. 20, 2017, the entire disclosures of which are herein expressly incorporated by reference.

BACKGROUND AND SUMMARY OF THE INVENTION

The invention relates to an exhaust flap for an exhaust system of a motor vehicle, to a control unit, and to a method for operating an exhaust flap of this type.

Such exhaust flaps for exhaust systems of motor vehicles, and such methods for operating such exhaust flaps, are already well known from the general prior art and in particular from series vehicle production. Here, the motor vehicle commonly comprises an internal combustion engine by means of which the motor vehicle can be driven. During the fired operation thereof, the internal combustion engine provides exhaust gas, which can flow through the exhaust system. The exhaust gas is thus discharged from the internal combustion engine via the exhaust system. Furthermore, the motor vehicle commonly has an electronic processing device for the closed-loop control and thus the operation of the internal combustion engine, wherein the electronic processing device will also be referred to as control unit, engine control unit or engine controller. Here, the exhaust flap has at least one valve element and at least one actuator by means of which the valve element is movable, in particular pivotable about a pivot axis. The valve element is commonly movable, in particular pivotable, between a closed position and at least one open position by means of the actuator.

The valve element is commonly arranged in an exhaust pipe through which the exhaust gas can flow, wherein the valve element is movable, in particular pivotable, relative to the exhaust pipe. In the closed position, the valve element fluidically shuts off at least a subregion of a flow cross section, which is flowed through by the exhaust gas, of the exhaust pipe, such that the exhaust gas cannot flow through the fluidically shut-off subregion. However, in the open position, the valve element opens up the subregion, such that the exhaust gas can flow through the opened-up subregion.

Such an exhaust flap is commonly used for sound modulation and sound intensity manipulation. In other words, by means of the exhaust flap, in particular by means of the valve element, it is for example possible for noises which are emitted by the motor vehicle, in particular by the internal combustion engine, to the surroundings of the motor vehicle, in particular of the exhaust system, and which are acoustically perceptible to the human ear of persons present in the surroundings, to be set or manipulated. Thus, for example, a noise which is emitted by the motor vehicle and which is acoustically perceptible to the human ear of persons present in the surroundings of the motor vehicle, and the sound intensity of the noise, is dependent on the valve element, in particular on the position thereof, in which the valve element is moved and in particular held by means of the actuator. For example, in its open position, the valve element opens up at least one resonator, whereby a particularly sporty and throaty noise can be set. In the closed position, the resonator is for example shut off by means of the valve element, resulting in a less sporty and instead comfortable noise, which is for example quieter than the noise in the open position.

It is therefore an object of the present invention to further develop an exhaust flap, a control unit and a method of the type mentioned in the introduction such that particularly advantageous sound modulation and sound intensity manipulation can be realized in a particularly simple manner.

A first aspect of the invention relates to an exhaust flap for an exhaust system of a motor vehicle which has an internal combustion engine and at least one electronic processing device for the closed-loop control or operation of the internal combustion engine, which motor vehicle is for example formed as a motor car, in particular as a passenger motor car, and can be driven by means of the internal combustion engine. The internal combustion engine, for example during the fired operation thereof, provides exhaust gas which can flow through the exhaust system and which is discharged from the internal combustion engine via the exhaust system. Here, the exhaust flap has at least one valve element and at least one actuator by means of which the valve element is movable, in particular pivotable about a pivot axis. For example, the valve element is arranged in an exhaust pipe, in particular of the exhaust flap, through which the exhaust gas of the internal combustion engine can flow, wherein the valve element is movable, in particular pivotable, relative to the exhaust pipe by means of the actuator. The electronic processing device for the closed-loop control of the internal combustion engine will also be referred to as control unit, engine control unit or engine controller.

To now be able to realize particularly advantageous sound modulation and sound intensity manipulation by means of the exhaust flap, in particular by means of the valve element and in this case in particular by means of the position thereof, in a particularly simple manner, the exhaust flap has a dedicated electronic processing device. In order to be able to hereinafter clearly distinguish the former electronic processing device for the closed-loop control of the internal combustion engine from the dedicated electronic processing device of the exhaust flap in terms of terminology, the electronic processing device for the closed-loop control of the internal combustion engine will also be referred to as first electronic processing device, first control unit, engine control unit or engine controller, wherein the dedicated electronic processing device of the exhaust flap will also be referred to as second electronic processing device, flap control unit, exhaust flap control unit or second control unit. The term "dedicated" relating to the second electronic processing device is intended to clarify or highlight that the flap control unit (dedicated electronic processing device of the exhaust flap) is not a constituent part of the engine control unit (electronic processing device for the closed-loop control of the internal combustion engine) and is not formed by the engine control unit, but rather the engine control unit and the flap control unit are, considered individually, in each case individual, mutually separately produced components, such that the flap control unit is a control unit which differs from and is provided in addition to the engine control unit.

The flap control unit is thus produced or manufactured independently of the engine control unit, and vice versa. Furthermore, the exhaust flap may, independently of the engine control unit, be equipped with the flap control unit, wherein it is conversely likewise the case that the motor vehicle may, independently of the exhaust flap or of the flap control unit, be equipped with the engine control unit. As will be discussed in more detail below, provision is furthermore made whereby the internal combustion engine or the motor vehicle as a whole may be fully functional if the exhaust flap and thus the flap control unit have not been installed, such that the exhaust flap is designed as a retrofit solution or retrofit product with which the motor vehicle can be equipped or fitted after itself being fully produced. The retrofit solution is also referred to as after-sales solution or after-sales product. In particular, it is conceivable, by means of the exhaust flap according to the invention, to replace a series exhaust flap that has initially been installed in the motor vehicle, and for the motor vehicle to thus be equipped with the exhaust flap according to the invention as a retrofit solution after the motor vehicle has itself been produced and equipped with the series exhaust flap. In this way, an initially installed series exhaust system of the motor vehicle can be converted to form a retrofit exhaust system, or replaced by a retrofit exhaust system.

Here, the dedicated electronic processing device of the exhaust flap, that is to say the flap control unit, is designed to receive at least one first signal, which is provided by the electronic processing device of the motor vehicle, that is to say by the engine control unit, and which characterizes a first position of the valve element, and to generate at least one second signal, which characterizes at least one second position of the valve element which differs from the first position, as a function of the received first signal. The flap control unit is furthermore designed to transmit the second signal to the actuator, in order to thus effect a movement of the valve element into the second position by means of the actuator, and in particular hold the valve element in the second position by means of the actuator.

The first signal is for example a first activation signal which is provided by the engine control unit in order, for example, to activate a series actuator of the series exhaust flap and consequently, by means of the first activation signal, move a series valve element of the series exhaust flap into the first position by means of the series actuator. In other words, if the motor vehicle, in particular the exhaust system thereof, is for example equipped with the series exhaust flap, then, by means of the first activation signal, the series actuator can be activated by the engine control unit in order to move, in particular pivot, the series valve element by means of the series actuator as a function of the first activation signal.

By means of the exhaust flap according to the invention, it is now possible to easily replace the series exhaust flap with the exhaust flap according to the invention, without the need for the engine control unit to be replaced or modified in laborious fashion, and at the same time to move the valve element not into the first position but into the desired second position. For this purpose, by means of the flap control unit, the second signal is generated and provided as second activation signal, such that an actual activation of the actuator of the exhaust flap according to the invention is realized not by means of the first signal but by means of the second signal. The valve element is duly moved on the basis of the first signal, since the second signal is generated in a manner dependent on the first signal, but here, the valve element is moved not into the first position but into the second position that differs from the first position. In this way, the motor vehicle can be equipped particularly easily and inexpensively with the exhaust flap according to the invention formed as a retrofit solution. Furthermore, by means of the exhaust flap according to the invention, the valve element can be moved as required, such that particularly advantageous sound modulation and sound intensity manipulation can be realized, or such that, here, an approval-relevant opening level which is similar to the series exhaust system can be realized in required ranges. The same applies to the exhaust back pressure, which is likewise dependent on the flap position or the angle. The back pressure should be identical to the series exhaust system in ranges in which GPF monitoring is active.

In relation to the motor vehicle or the series exhaust flap, it is thus possible for the valve element to be manipulated in terms of its position in a simple manner in accordance with demand, and thus to generate a desired noise in a desired sound intensity in accordance with demand, without the need to modify or exchange the engine control unit in laborious fashion. Since the flap control unit receives the first signal provided by the engine control unit, the flap control unit simulates, for example, the series exhaust flap replaced by the exhaust flap according to the invention, such that the engine control unit does not detect that the exhaust flap according to the invention has been installed instead of the series exhaust flap. In this way, fault reports can be avoided. The exhaust flap according to the invention thus permits the simple and inexpensive realization of an exhaust flap actuator functionality as a retrofit solution for motor vehicles, in particular for exhaust systems of motor vehicles. By means of the exhaust flap, it is thus for example possible for the valve element that has been closed or opened by means of the first signal to be closed further or opened further by means of the second signal than would be effected by means of the first signal. In this way, it is for example possible for a noise emitted by the motor vehicle, in particular by the internal combustion engine, to the surroundings of the motor vehicle, in particular via the exhaust system, and the sound intensity of the noise, to be set, and manipulated or varied in particular in relation to the series exhaust flap, in accordance with demand without the need for laborious modifications to or an exchange of the engine control unit. For example, the valve element is movable, in particular pivotable, between at least one closed position and at least one open position.

In the closed position, it is for example the case that the valve element shuts off at least a subregion of a flow cross section, which can be flowed through by the exhaust gas, of the exhaust pipe, such that the exhaust gas cannot flow through the fluidically shut-off flow cross section. However, in the open position, the valve element opens up the subregion, such that the exhaust gas can flow through the opened-up subregion. The valve element, for example in its open position, opens up a damping means, in particular a resonator, wherein the valve element, in the closed position, shuts off the resonator or the damping means. In this way, it is for example possible, by means of the open position of the valve element, for a louder and/or sportier noise in relation to the closed position to be set, wherein, in the closed position, it is for example possible for a quieter and in particular more comfortable noise in relation to the open position to be set. If, for example, the series exhaust flap is exchanged in a simple manner for the exhaust flap according to the invention, then the valve element of the exhaust flap according to the invention can for example be moved into the closed position or into the open position under different conditions in relation to the series valve element of the series exhaust flap, such that, for example, the open position or the closed position of the valve element can be set under different conditions. The setting of the closed position, of the open position or of a position of the valve element generally is to be understood to mean that the valve element is moved into the respective position, and in particular held in the respective position, by means of the actuator.

When the exhaust flap or valve element is closed, the exhaust gas passes through a muffler part, which exhibits the greatest damping action. The part then also exhibits the greater part of the exhaust back pressure. With the exhaust flap open, the exhaust gas passes in parallel through a part which exhibits less damping. Less damping normally also means less exhaust back pressure. The exhaust gas follows the easier path and thus the branch with less damping. A part however also passes through the part with the greater damping action. Present exhaust flaps do not switch over, but rather only open up or connect in one part.

Here, the invention is based in particular on the following realization: in the automotive sector, exhaust flaps are increasingly being used on exhaust systems. These exhaust flaps may be pneumatically or electrically operable or activatable or activated. In particular, such an exhaust flap, in particular its valve element, is utilized in order to actively connect in at least one damping means, in particular a resonator or resonators. Here, the exhaust flap is utilized not to simply generate a particularly loud noise that is unpleasant to persons present in the surroundings of the motor vehicle, but rather to avoid such unpleasant noises. At least almost every internal combustion engine, in particular turbocharged engine, also referred to as engine, combustion motor or combustion machine, has, in low speed and load ranges, operating points at which the charge exchange or the entire engine/exhaust tract structure is noticeable owing to booming, droning characteristics. To nevertheless permit comfortable driving here, damping means, in particular resonators, are therefore structurally implemented in respective mufflers of the respective exhaust systems. The abovementioned resonator or the damping means can thus alternatively or additionally be utilized for realizing a pleasant and comfortable noise and consequently comfortable driving. Commonly, such a resonator or such a damping means however has an adverse effect on the exhaust back pressure, which is undesired with regard to charge exchange and consumption. To now minimize or avoid droning and booming ranges, and to preferably do so only for the ranges in which this is actually required, adjustable exhaust flaps are used in order to be able to targetedly manipulate the exhaust gas, in particular the flow or stream thereof. For example, by means of characteristic maps, the resonator and/or a damped branch or damped branches can be connected in only where, or in ranges in which, this is actually desired. An exhaust flap can thus be utilized to prevent unpleasant and excessively loud noises which are emitted by the motor vehicle to the surroundings thereof.

It is commonly sought to use exhaust flaps to achieve a compromise between what is admissible or predefined and what is desired in particular by the customer. At the same time, it is sought not to generate unnecessary damping, because this causes exhaust back pressure. In certain speed/load ranges, exhaust back pressure comes at the expense of power, and compensation comes at the expense of fuel, which in turn leads to $CO_2$ emissions.

In sporty vehicles, the entire muffler volume may be required to achieve sufficient damping in the first place. This is realized for example by absorption and/or particularly long pipelines. Thus, relatively intense damping can be realized without greatly increasing the exhaust back pressure. There is then no further remaining volume available for reflection mufflers or resonators. Reflection mufflers can duly impart a good damping action but also overly increase the exhaust back pressure. Resonators duly generate little exhaust back pressure, but they normally impart damping only in a very small range.

Exhaust flaps are however often used over a very much broader range. Aside from an acoustic differentiation between different drive modes, in particular, for example, between a comfort mode and a sport mode, exhaust flaps are also used for pass-by noise approval purposes. By means of an exhaust flap of the type, an excessive noise emitted by the motor vehicle, in particular by the internal combustion engine, via the exhaust system, or the sound intensity of the noise, can be kept low under such conditions, or in such operating ranges, under or in which this is desired. In other ranges, it is possible—for example in order to realize sporty acoustics, for the exhaust system to be dethrottled by virtue of the exhaust flap or the valve element being opened. Here, exhaust flaps are known which are formed as open-closed flaps. Here, the valve element is movable only between exactly two mutually different positions, wherein one of the positions is for example the abovementioned closed position, and the other of the positions is the abovementioned open position. Furthermore, closed-loop-controlled exhaust flaps are conceivable in the case of which the exhaust flap or the valve element can be moved into, and held in, at least one intermediate position, in particular multiple intermediate positions, between the closed position and the open position. By means of the auxiliary flap control unit according to the invention, including function, it is possible, with corresponding adaptation characteristic maps and closed-loop-controlled exhaust flaps, for the level and pressure characteristics of a series exhaust system to be emitted even with an exhaust system of differing construction.

An exhaust flap of the type, in particular the actuator thereof, is commonly activated at least substantially directly by the engine control unit and thus by means of the first signal. The first signal is commonly an information item relating to whether the exhaust flap, or the valve element thereof, should be opened or closed. In the case of a pneumatically operable exhaust flap, the engine controller, in particular by means of the first signal, adjusts an electrical switchover valve, which then effects or releases a negative pressure for the movement of the valve element. In the case of such a pneumatically operable exhaust flap, the actuator is thus formed for example as a pneumatic actuator, which comprises for example the electric switchover valve.

In the case of electrically adjustable exhaust flap systems, various systems exist. In the simplest case, the actuator is seated on the valve element, which actuator is formed as an electric adjusting drive and may have a certain degree of inherent artificial intelligence. Here, for example, internal electronics are installed which can move the valve element independently into its respective end stops. A first of the end stops is for example the abovementioned closed position, wherein another of the end stops is for example the abovementioned open position. The valve element may in this case be moved for example from end stop to end stop but not beyond these. Here, the adjusting drive or actuator, formed as an electric exhaust flap adjuster commonly receives, for example from the engine controller, the first signal, which is for example in the form of a PWM (pulse width modulation) signal. In particular, the electric exhaust flap adjuster receives the PWM signal with a fixed base frequency. Defined pulse-interval ratios are then assigned to respective desired positions or settings of the adjuster or of the valve element. A 10% PWM signal corresponds for example to the desire to open the valve element, such that, for example, the valve element is opened, that is to say moved into the open position, by means of such a 10% PWM signal.

A 90% PWM signal corresponds for example to the desire to close the valve element, such that, for example, the valve element is closed, that is to say moved into the closed position, by means of such a 90% PWM signal. The electric exhaust flap adjuster then moves for example independently to a respective stop or to the respective position, and identifies this by an internal current measuring means at the adjusting motor or at the power electronics thereof. At the flap stop, the drive current increases, and the actuator, also referred to as adjuster, independently shuts off. Modern systems may even move to intermediate positions and, for this purpose, are internally equipped with an additional position or situation identification means. Furthermore, such exhaust flap closed-loop controllers are known which use exhaust flap adjusters or actuators which comprise only one adjusting motor for moving the valve element. In the case of these systems, power drivers formed for example as H-bridges are accommodated in the actuator or in the engine controller. These systems are much more complex in terms of the hardware in the engine controller, but can control the exhaust flap or the valve element in closed-loop, continuously variable fashion into any desired setting or position, similarly to the situation with a throttle flap.

Use is made of control via a signal line as PWM. The same applies to any position feedback, which can be realized by a separate line likewise as a PWM signal. Even if position feedback is not presently used, it may possibly be necessary in future, in particular if future use of gasoline particle filters (GPF) is intended. Exhaust flap manufacturers already offer this. Alternatively, the manufacturers of exhaust flap adjusters also offer LIN bus activation. Via a LIN bus, activation and position feedback could be transmitted in parallel, that is to say in a more modern fashion, and if one then also provides two adjusters with different addresses, further lines can be saved. There may possibly also be other bus systems that will be implemented in future.

In one advantageous embodiment of the invention, the valve element is movable in an adjustment range which comprises the second position and a multiplicity of further positions. Here, the exhaust flap is designed to move the valve element into the positions of the adjustment range, and to hold the valve element in the positions of the adjustment range, by means of the dedicated electronic processing device (flap control unit) and by means of the actuator on the basis of the receipt of the first signal. In other words, in this embodiment, provision is made whereby the valve element is moved into, and held in, the different positions of the adjustment range by means of the flap control unit and be mean of the actuator even though the flap control unit receives only the first signal or the first signal which characterizes only the first position. If, for example with regard to the series exhaust flap, provision is made for the series valve element of the series exhaust flap to be moved by means of the engine control unit only between the first position and a further end position and thus either into the first position or into the further end position, then this can, by means of the exhaust flap according to the invention formed as a retrofit solution, be modified in an advantageous and particularly simple manner such that, if only the first position is in fact set or to be set by means of the engine control unit, the valve element is moved into multiple, mutually different positions of the adjustment range, in particular whilst the engine control unit provides the first signal.

In other words, provision is preferably made whereby, whilst the engine control unit provides the first signal or whilst the flap control unit receives the first signal and thus the first position, the valve element is, on the basis of the receipt of the first signal, moved into the multiple, mutually different positions of the adjustment range, in particular by means of the flap control unit and by means of the actuator and, here, in particular by means of the second signal or by means of multiple second signals, which characterize(s) the respective positions of the adjustment range. Thus, it is for example possible for the valve element to be changed or varied with regard to its position whilst the engine control unit outputs only the first signal and thus the first position, and thus demands, or seeks to set, only the first position. Thus, particularly advantageous sound modulation and sound intensity manipulation can be realized without the engine control unit detecting a fault or a malfunction, such that faults and fault states do not occur.

To be able to realize particularly advantageous sound modulation and sound intensity manipulation, in particular by means of the valve element and, here, in particular by means of the position or positions thereof, provision is made, in a further embodiment of the invention, whereby the exhaust flap is designed to move the valve element into respective positions of the adjustment range, and to hold the valve element in the respective positions, by means of the dedicated electronic processing device by means of the actuator, and, here, in particular by means of the second signal or by means of the multiple second signals, in continuously variable fashion. In this embodiment, the exhaust flap according to the invention is not designed for example as a simple open-closed exhaust flap, the valve element of which is movable only between exactly two positions or into positions in stepped fashion, but rather the exhaust flap is designed such that the valve element can be moved into the positions of the adjustment range, in particular into each position of the adjustment range, and can be held in the respective position, in continuously variable fashion and thus in particular accordance with demand. In this way, the abovementioned flow cross section of the exhaust pipe can be at least partially opened up and fluidically shut off in particular accordance with demand and in particular in at least substantially continuous and thus transition-free fashion, whereby particularly advantageous sound modulation and sound intensity manipulation can be realized.

A further embodiment is distinguished by the fact that the dedicated electronic processing device (flap control unit) is designed to receive data which are provided by the electronic processing device of the motor vehicle, that is to say by the engine control unit, and to generate the second signal and thus the second position as a function of the received data, wherein the data characterize at least one state of the motor vehicle which differs from the first position. In other words, the data characterize at least one state of the motor vehicle, wherein the state differs from the first position and thus does not comprise or characterize the first position. In this embodiment, provision is thus made whereby the second signal and thus the second position is generated or set not only as a function of the first position but also as a function of at least one additional criterion that differs from the first position, wherein the abovementioned state comprises or characterizes the stated criterion. It is thus for example possible for the valve element, in particular the position thereof, to be adapted in particular accordance with demand to the state of the motor vehicle, in particular of the internal combustion engine, whereby particularly advantageous sound modulation and particularly advantageous sound intensity manipulation can be realized.

Here, it has proven to be particularly advantageous if the state comprises a rotational speed of the internal combustion engine or of an output shaft of the internal combustion engine and/or a torque or a load of the internal combustion engine and/or a position of an accelerator pedal of the motor vehicle and/or a set drive mode of the motor vehicle and/or a state of an operator control element which can be actuated by a person and which serves for the operator control of the exhaust-gas flap. The valve element can thus be moved as a function of the state or as a function of the above-stated criterion into different positions, whilst for example the engine control unit provides the first signal and thus the first position in at least substantially constant fashion and the flap control unit receives the first signal and the first position, and if the state changes.

In other words, if for example the state changes, wherein the state or the change thereof is characterized by the data, whilst the first signal or the first position does not change, that is to say whilst the flap control unit receives the first signal and thus only the first position, then the valve element can be moved by means of the actuator, by means of the flap control unit and by means of the second signal into different positions, even though the first signal or the first position does not change. It is thus possible for the valve element, in particular the position thereof, to be adapted to the changing state or to changes in the state, even though only the first position is demanded by the engine control unit. Thus, if for example the series exhaust flap were installed, changes in the position of the series valve element would not occur despite the changes in the state, because the engine control unit demands the first position despite the change in the state. Since it is however now possible in the described manner for the series exhaust flap to be replaced in a particularly simple and inexpensive manner with the exhaust flap according to the invention, the valve element can, owing to changes in the state, be moved, and thus moved into different positions, in particular by means of the second signal or by means of multiple second signals, even though, and whilst, the engine control unit demands only the first position.

In a further embodiment of the invention, in a memory device of the dedicated electronic processing device (flap control unit), there is stored a characteristic map which comprises the second position and multiple positions which differ from one another and from the second position, wherein the dedicated electronic processing device (flap control unit) is designed to select one of the positions of the characteristic map from the characteristic map, and to effect a movement of the valve element into the selected position by means of the actuator, as a function of the received first signal. Thus, for example, the second signal characterizes the selected position, such that the valve element can be moved by means of the second signal into the selected position. In particular, the valve element is held by means of the actuator in the selected position, whereby particularly advantageous sound modulation and sound intensity manipulation can be realized. Here, provision is preferably made whereby the positions of the characteristic map are the positions of the adjustment range.

Through the utilization of the characteristic map, it is possible for the first signal or the first position to be corrected, such that the valve element is moved not into the first position demanded by the engine control unit but into the second position which differs from the first position or into the selected position which differs from the first position. In particular, it is thus possible, on the basis of the characteristic map, for the valve element to be moved into different positions selected from the characteristic map whilst the engine control unit demands only the first position. In this way, the noise emitted by the motor vehicle, in particular the internal combustion engine, to the surroundings of the motor vehicle, in particular via the exhaust system, and the sound intensity of the noise, can be influenced in particular accordance with demand.

To be able to move the valve element in particular accordance with demand and particularly quickly, provision is preferably made whereby the actuator is formed as an electrically operable actuator, that is to say as an electric actuator.

Finally, it has proven to be particularly advantageous if the exhaust flap is designed to detect at least the second position, to generate a feedback signal, which characterizes the first position, as a function of the detection of the second position, and to provide the feedback signal to the electronic processing device of the motor vehicle, by means of the dedicated electronic processing device (flap control unit). In particular, the flap control unit can for example detect respective, mutually different positions of the valve element, which is moved into the mutually different positions for example on the basis of the characteristic map, and generate the feedback signal, which characterizes the first position, and provide the feedback signal to the electronic processing device of the motor vehicle, as a function of the detection of the respective position. The flap control unit can preferably detect the respective positions of the adjustment range or of the characteristic map and generate the feedback signal, which characterizes the first position, and provide the feedback signal to the electronic processing device of the motor vehicle, as a function of the detection of the respective position.

This embodiment is based in particular on the following realization: the engine control unit may for example be designed to detect the position of the valve element in particular in the context of a diagnostic function. As described above, the engine control unit demands the first position by means of the first signal, wherein, however, at least the second position, which differs from the first position, of the valve element is set by means of the second signal. If, for example, the exhaust flap were to now detect the set second position of the valve element and feed the detected second position back to the engine control unit, in particular by way of the feedback signal, then the engine control unit would detect and report a fault, because the engine control unit would detect that the actually set second position of the valve element differs from the first position demanded and desired by the engine control unit. A fault report, or a fault entry, would consequently occur even though the exhaust flap is functional and the valve element moves into, and is held in, the actually desired second position. To now avoid such undesired and erroneous fault detection, the flap control unit reports back to the engine control unit, by way of the feedback signal, not the second position that is actually set as desired but the first position that is demanded by the engine control unit, whereby the engine control unit detects fault-free functioning, which is also actually the case.

In other words: the engine control unit is for example basically designed to check whether the first signal provided by the engine control unit actually gives rise to the first position of the valve element, that is to say whether the valve element is actually situated in the first position demanded by the engine control unit. If, for example, the series exhaust flap were installed and functional, the first signal would actually lead to the series valve element actually being situated in the first position demanded by the engine control unit. The engine control unit would detect this and would diagnose fault-free functioning of the series exhaust flap.

Since the second position and not the first position of the valve element is however now set by means of the flap control unit, if the actually set second position were fed back to the engine control unit, then a fault report would arise, because the engine control unit would detect that the second position differs from the first position desired by the engine control unit. Therefore, not the actually set second position but rather the first position demanded by the engine control unit is fed back.

Here, to nevertheless realize an advantageous diagnostic function, the flap control unit is preferably designed to detect the position of the valve element or to check whether the valve element is actually situated in the second position, that is to say whether the second signal actually gives rise to the second position. If it is for example detected by the flap control unit that the valve element is situated not in the second position demanded by the flap control unit but rather in a position that differs from the second position, such as for example the first position, the flap control unit assumes a fault or a malfunction, because the second signal should have given rise to the second position, but has not done so. Consequently, for example, not the first position but rather a position that differs from the first position is fed back by way of the feedback signal to the engine control unit. In this way, it is communicated to the engine control unit that a malfunction is present, because it is simulated that the valve element is not situated in the first position demanded by the engine control unit. Altogether, it is thus possible to realize a particularly advantageous diagnostic function, because undesired and unnecessary fault reports can be avoided, and it is only when a malfunction of the exhaust flap is actually present that the detection of faults occurs and fault reports arise.

A second aspect of the invention relates to a control unit for an exhaust flap, which has at least one valve element and at least one actuator by means of which the valve element is movable, of an exhaust system of a motor vehicle, wherein the control unit is designed to receive at least one first signal, which is provided by an electronic processing device of the motor vehicle, in particular of the exhaust system, and which characterizes a first position of the valve element, to generate at least one second signal, which characterizes at least one second position of the valve element which differs from the first position, as a function of the received first signal, and to transmit the second signal to the actuator, in order to thus effect a movement of the valve element into the second position by means of the actuator. Advantages and advantageous embodiments of the first aspect of the invention are to be regarded as advantages and advantageous embodiments of the second aspect of the invention, and vice versa. The control unit according to the invention is thus for example the abovementioned, dedicated or second electronic processing device, by means of which particularly advantageous sound modulation can be realized.

The control unit according to the invention thus offers the possibility of operating the exhaust flap of the exhaust system, which is formed for example as an after-sales exhaust system, such that, firstly, a particularly emotive noise can be realized and, secondly, specifications in this regard concerning the prevention of excessively loud noises can be satisfied, in particular with regard to the pass-by noise regulation R51.03.

The control unit according to the invention is thus a control unit which for example simulates the behavior and the hardware of the for example switched exhaust flaps with respect to engine control, in particular also with regard to diagnostic feedback items or any position feedback. The control unit according to the invention then activates the exhaust flap no longer in switched fashion but rather in closed-loop-controlled fashion on the after-sales exhaust system. In other words, by means of the control unit according to the invention, it is for example possible for the exhaust flap, which is actually controlled and thus adjustable only between two discrete positions, or the valve element of the exhaust flap, to be operated as a closed-loop-controlled exhaust flap or as a closed-loop-controlled valve element, such that the valve element moves in at least substantially continuous fashion between the positions and also into multiple other positions arranged in particular between the positions, and can be held in the positions. The control unit detects for example when the engine control, realized for example by means of the electronic processing device of the motor vehicle, would switch the valve element, formed for example as a flap, of the series exhaust system, and then correspondingly activates the closed-loop-controlled exhaust flap or respective, multiple closed-loop-controlled exhaust flaps of the after-sales exhaust system.

In the ranges or operating states of comfort, sport and sport+, the control unit now ensures, by means of positions stored in the characteristic map, that the after-sales exhaust system is, with regard to level, situated at approximately the same level as the series exhaust system. It is thus ensured that, by means of an after-sales exhaust system, by means of which more emotive noises can be realized by means of the series exhaust system, in particular in approved ranges, an adequately low level, that is to say a level which corresponds to the series exhaust system, can be output with corresponding positions or angles of the valve element. The control unit has not only the signals "open" and "closed" for the activation of the switched exhaust flaps, for example via CAN bus, but also information items relating to rotational speed, torque, gear ratio, drive modes, and can make further differentiations here in the characteristic maps.

Aside from the levels for the approved ranges, it is possible with closed-loop-controlled exhaust flaps, which are also referred to simply as flaps, and by means of corresponding characteristic maps, for the entire opening level of an after-sales exhaust system to be configured similarly for the normal ranges of comfort, sport and sport+. This would have advantages in the interaction with the artificial exhaust muffler sound that is imparted to the driver in the vehicle. The exhaust muffler sound is applied on the basis of the series exhaust opening. Aside from the sound, the applied level in particular is of importance here. Where a series exhaust system allows a low level into the vehicle interior, more is played on top, and where the series exhaust system has conspicuous level peaks, less is played in. The overall pattern must be harmonious.

During the level run-up, an after-sales exhaust system normally has other level troughs and peaks. Internal active sound (IASD) and after-sales exhaust systems are therefore often incompatible. If an after-sales exhaust system has a level maximum where the series exhaust system has a drop in level, this can be unpleasant for the driver. The artificial sound system has, in the series trough, already compensated or added the level trough. The after-sales exhaust system adds yet more on top of this. Both together could be too much. The control unit according to the invention now has, for example, at least one characteristic map which compensates this.

For this purpose, the series exhaust system is for example measured on a roller test stand. The levels for flap or valve element "open" and "closed" can be determined, and corresponding run-ups with different torque can be run through. An identical approach is followed with the after-sales exhaust system, only with a difference here that the flap(s) is or are measured not only in the "open" and "closed" mode but also in the intermediate positions, for example "closed=0%", 5%, 10%, 15% . . . 80%, 85% and "open=80%". The characteristic maps can then be fed with the determined curves. With this implementation, although the after-sales exhaust system may sound different, the levels are approximately identical.

In the after-sales sector, it is often sought to utilize a switch by means of which the exhaust flap(s) are opened. This, too, can then be implemented again. Here, a further characteristic map may perform precontrol of the exhaust flap only in the ranges where it is required for approval. All ranges which do not require approval may be configured to be loud without restriction. The transitions can then be configured to be extremely abrupt, or with a smooth transition, by the control unit. Conversely, the fault feedback and any position feedback that is provided should also be provided via characteristic maps. The engine controller should receive what it expects, that is to say the protocol should be adhered to. Aside from the level, the exhaust back pressure may also play an important role, which is of relevance in particular with the introduction or use of a GPF (gasoline particle filter).

In principle, the exhaust flap, or its valve element, for example opens up a tract with relatively little damping. The exhaust flap also cannot switch over, because the damped exhaust tract remains present. The damped part also causes a greater exhaust back pressure. Thus, if an exhaust flap or the valve element is opened, then the exhaust gas always seeks to follow the easier path, that is to say the path with less damping, where the flap or the valve element is commonly installed or which is opened up by the flap or valve element. In the series exhaust system, the exhaust flap is however normally also followed by more damping. This is either an upstream damping means, which also acts for the closed flap, or a downstream damping means. In the after-sales sector, in the past, exactly this region has been utilized to generate a greater level. The upstream damping means has been removed and has been added again in the flap "closed" region, and damping in the flap "open" branch has been minimized. Exactly this approach then no longer functions with the conventional flap implementation and control.

A third aspect of the invention relates to a method for operating an exhaust flap for an exhaust system of a motor vehicle which has an internal combustion engine and at least one electronic processing device for the closed-loop control of the internal combustion engine, having at least one valve element of the exhaust flap, and having at least one actuator of the exhaust flap by means of which the valve element is moved.

To now be able to realize particularly advantageous sound modulation and sound intensity manipulation in a particularly simple manner, provision is made according to the invention whereby the exhaust flap has a dedicated electronic processing device which receives at least one first signal, which is provided by the electronic processing device of the motor vehicle and which characterizes a first position of the valve element, generates at least one second signal, which characterizes at least one second position of the valve element which differs from the first position, as a function of the received first signal, and transmits the second signal to the actuator, whereby the valve element is moved into the second position, and in particular is held in the second position, by means of the actuator. Advantages and advantageous embodiments of the first aspect and of the second aspect of the invention are to be regarded as advantages and advantageous embodiments of the third aspect of the invention, and vice versa.

The control unit or method according to the invention thus offers or is a function which makes it possible for two identical adjuster concepts (switched) or two different adjuster concepts (switched basic/closed-loop-controlled after-sales) to be connected such that an after-sales exhaust system can be operated under more arduous, new conditions (as regards sound and exhaust back pressure) and approved as regards the opening level, all without the engine controller being able to identify this, in particular with regard to the signals that the series adjusters commonly send back, with regard to the exhaust back pressure which a series exhaust system commonly provides with flap "open/closed" and which, in combination with a particle filter, constitutes an important monitoring value for the filter regeneration.

Altogether, it can be seen that the actuator is an adjuster of the exhaust flap. The adjuster commonly has a dedicated controller, wherein a controller may also be understood to mean a closed-loop controller. The reason for this is the activation. In principle, an engine controller could also directly control a flap of the type. The engine controller would however then have to run two lines to the exhaust flap at the rear in the motor vehicle in order to directly operate the small adjusting motor. This is highly cumbersome, and almost impossible specifically in the case of closed-loop-controlled flaps without position feedback to the engine controller. The outlay consists in the lines. An electrical exhaust flap has only an activation line, and it receives a supply of electricity locally. If the engine controller were to provide this, it would require a second line exclusively for the activation. For the position detection, yet another line would possibly be provided, all of which is highly cumbersome, and the power electronics would have to be provided or implemented in the engine controller. Independently operating electrical adjusters have therefore become established.

Altogether, it can furthermore be seen that the control unit according to the invention is installed instead of the series exhaust flap or instead of the control unit of the series exhaust flap, wherein the control unit according to the invention for example simulates the series exhaust flap(s) and the protocol that the engine control unit expects. On the flap control unit according to the invention there is or are seated for example one or more, for example closed-loop-controlled exhaust flaps, in particular from the after-sales sector. This/these exhaust flap(s) may also be the conventional switched flaps. The control unit according to the invention now ensures that the adjustment demand from the engine control unit is, with the after-sales exhaust system, adapted with regard to level and exhaust back pressure in relevant ranges by means of at least one characteristic map, and also corresponding fault reports, which may differ in the case of different adjusters, are correspondingly converted or adapted.

The control unit (flap control unit) according to the invention may, for example by means of a retrofitted switch, open the flap(s) or the valve element or the valve elements, but specifically no longer to the extent that was possible in accordance with the old pass-by noise regulation. In approval-relevant ranges and in the ranges in which a defined exhaust back pressure is expected, the switch demand is of secondary priority, because function and legislation take precedence over driver demand.

In the engine controller, it would be necessary for variant characteristic maps to be provided for the different exhaust system, that is to say for example for the after-sales exhaust system, or separate datasets must be run and maintained. All of this would give rise to considerable costs. This can now be avoided through the use of the control unit according to the invention.

Through the use of the control unit according to the invention, the engine control unit or the engine controller does not detect the after-sales exhaust system or after-sales flap installed instead of the series exhaust system or instead of the series exhaust flap, but rather believes that the switched series exhaust flaps are installed. If a fault arises, then it can also only handle the fault reports that an electrical adjuster of an exhaust flap the type can deliver. If the flap control unit according to the invention, including functionality, is now installed instead of the switched exhaust flap, the control unit performs the fault reporting. The fault reports however originate no longer from a switched exhaust flap but from a closed-loop-controlled exhaust flap. These may be completely different depending on adjuster and the software running on the adjuster. The form of transmission may also differ. Such a closed-loop-controllable adjuster may for example be activated not by PWM but via LIN. Correspondingly, the fault protocols may possibly also differ. The flap control unit must correspondingly convert the protocols in order that they arrive at the engine control unit in the correct form. The flap control unit must ensure that an engine control unit feeds back all information items in the form in which a normal switched adjuster would do. The same also applies for example for a returned position signal. This applies even though we do not use one of these at present.

If a switched exhaust flap adjuster were used in the series configuration, this could feedback only the stop positions. During the switching process, intermediate values would duly arise, but only because the exhaust flap adjuster passes through these until it reaches the stop. A static value between the stops would be interpreted by the exhaust flap adjuster as a fault. A closed-loop-controllable exhaust flap would also assume positions which lie between 0 and 90% of the series exhaust flap. This is the advantage of a closed-loop-controlled exhaust flap and the combination with an after-sales exhaust system. If the engine controller switches the presumed exhaust flap to the "open" state, and the flap or auxiliary control unit can "open" the new closed-loop-controlled exhaust flap only to 70% at this operating point, because it is otherwise too loud for the pass-by noise measurement, then not 70% but rather 90% may be fed back to the engine controller at this point. This is what the engine control unit expects. A relatively long period of time at 70% would otherwise be regarded by the engine control unit as a fault.

The level adaptation and the pressure adaptation play an important role. Most vehicles have different drive modes. These are for example comfort, sport and sport+. For the respective modes, there are exhaust flap characteristic maps which, by means of gear ratio, engine speed, pedal value and possibly load and/or exhaust mass flow, open and close the flaps, presently by only closing or opening the flaps in the series configuration. In future, use could also be made of closed-loop-controlled exhaust flaps which then behave similarly, but specifically also with intermediate positions.

Sellers of after-sales exhaust systems have, in the past, always offered a remote controller by means of which it has been possible to switch the flap by means of a switch. This activation means always started with the flap closed, and thus always in an approved state, upon a restart. Switches are now no longer or scarcely implementable, because now all modes and switches must be checked in accordance with the new pass-by noise regulation. After-sales sellers can no longer satisfy this. The control unit according to the invention, including function, is intended to make all of this possible again, irrespective of whether the series configuration uses a switched or closed-loop-controlled exhaust flap and the after-sales exhaust system has a switched or closed-loop-controlled exhaust flap. All combinations are thus possible. The characteristic map can then ensure that, of a relatively loud exhaust system, the levels in comfort and sport and sport+ are, with adapted flap angles, similar to those of the series configuration. There would then be fewer complaints with regard to the artificial sound assistance by means of electronics such as internal active sound. In approval-relevant ranges, it would then be possible for the same pass-by level to be implemented by means of the corresponding adaptation characteristic maps. The same applies to the comfort ranges.

The same also applies to the future use of gasoline particle filters. These must be monitored with regard to exhaust back pressure, which is presently proving to be very difficult. On the basis of the exhaust back pressure, an item of software must initiate a corresponding regeneration in order that the filter is burned clear again. The filter is otherwise blocked at some point in time. Exhaust back pressure comes at the expense of fuel and thus $CO_2$ and also power. If an after-sales exhaust system thus, in future, has a different exhaust back pressure, it may be the case that the engine controller cannot distinguish this from a blocked filter. The engine controller then possibly initiates a regeneration too often or even too seldom, both of which are unacceptable. Aside from the level adaptation for acoustics and approval, it is then also possible for the exhaust back pressures of an after-sales exhaust system to be adapted to identical values to those of a series exhaust system, in particular if one knows the exact operating ranges in which the engine controller is lacking.

If, for example, it is not of importance to adapt the levels with regard to artificial sound and the comfort range, then it is merely necessary to ensure the approval-relevant ranges and the range for the GPF measurement. It would then be possible, with a switch depressed, for only these small ranges to be parameterized with corresponding exhaust flap angles by means of a characteristic map. Here, it would even be possible to operate more closely to the pedal limit curves of the ASEP envelope curve. All ranges outside the new pass-by noise regulation and all ranges in which the exhaust back pressure is not considered would be freely applicable. Here, it would be possible for an exhaust flap to be opened up fully without restriction, or for the exhaust flap to be operated only with angles which differ from the basic acoustics. The control unit has, via the CAN bus, the engine speed, gear ratio, torque, pedal angle etc., and thus all information items required to implement this exactly.

Further details of the invention will emerge from the following description of preferred exemplary embodiments with the associated drawings.

Other objects, advantages and novel features of the present invention will become apparent from the following detailed description of one or more preferred embodiments when considered in conjunction with the accompanying drawings.

DETAILED DESCRIPTION OF THE DRAWINGS

In the figures, identical or functionally identical elements are denoted by the same reference designations.

Figure 1:
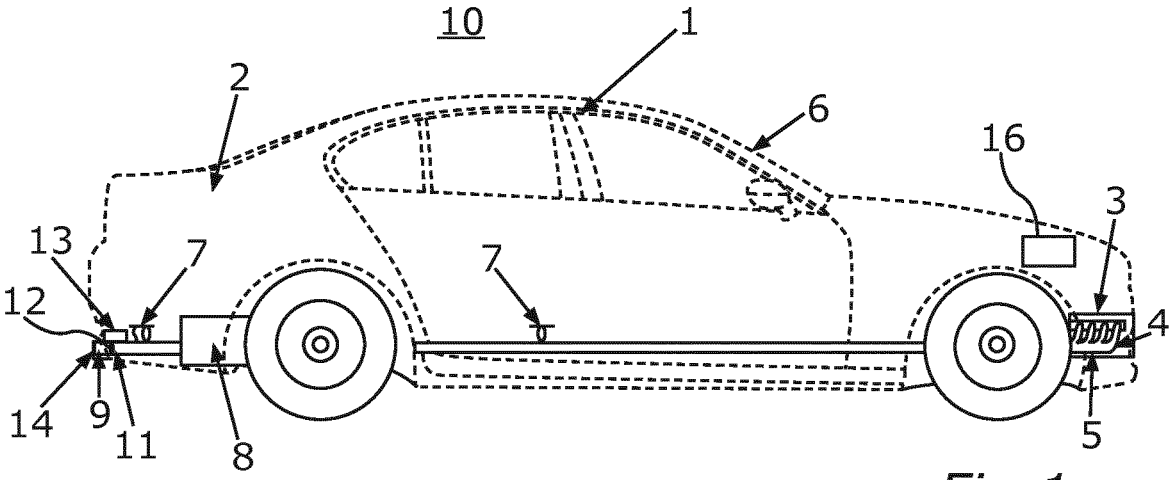
FIG. 1 shows a schematic side view of a motor vehicle in the form of a passenger motor car, having an internal combustion engine for driving the motor vehicle, having an exhaust system which can be flowed through by exhaust gas of the internal combustion engine, having an electronic processing device for the closed-loop control of the internal combustion engine, and having an exhaust flap according to the invention arranged in the exhaust system.
Figure 2:
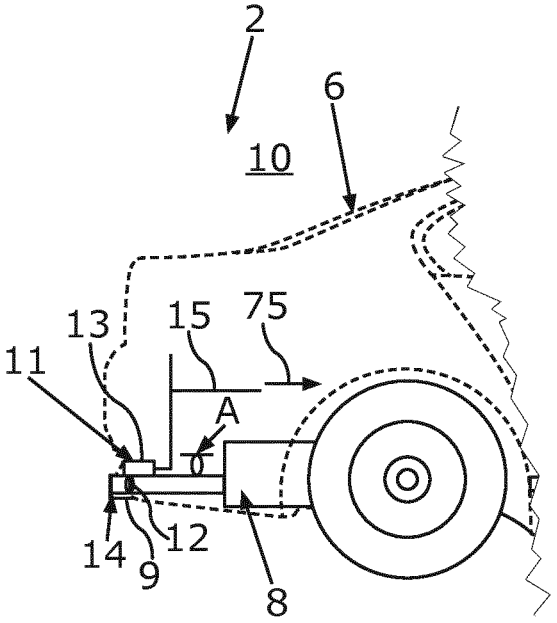
FIG. 2 shows, in a detail, a schematic and enlarged side view of the motor vehicle.

FIG. 1 shows, in a schematic side view, a motor vehicle 1 formed as a motor car, in particular as a passenger motor car, wherein a rear-end region 2 of the motor vehicle 1 is illustrated on an enlarged scale in FIG. 2. The motor vehicle 1 has an internal combustion engine 3 by means of which the motor vehicle 1 can be driven. The internal combustion engine 3 is also referred to as engine, combustion motor or combustion machine, and is formed for example as a reciprocating-piston engine. The internal combustion engine 3 has at least one combustion chamber, in particular multiple combustion chambers, wherein the respective combustion chamber is formed preferably as a cylinder. During fired operation of the internal combustion engine 3, at least fuel and air are fed to the combustion chamber, such that a fuel-air mixture forms in the respective combustion chamber. The fuel-air mixture is ignited, in particular by applied ignition, and thereby burned, which results in exhaust gas of the internal combustion engine 3. The fuel is for example a liquid fuel for the operation of the internal combustion engine 3.

The motor vehicle 1 furthermore has an exhaust system 4, which can be flowed through by the exhaust gas. The exhaust gas is discharged from the internal combustion engine 3 or from the combustion chamber via the exhaust system 4. Here, the exhaust system 4 comprises for example a manifold 5, also referred to as exhaust manifold, by means of which, for example, the exhaust gas from the multiple combustion chambers is collected.

The exhaust system 4 is, in particular in a vehicle vertical direction, arranged below an underfloor of the motor vehicle 1, in particular a body 6 of the motor vehicle 1, and held here on the underfloor. In the exemplary embodiment illustrated in FIGS. 1 and 2, the body 6 is formed as a self-supporting body or bodyshell. Here, it is possible from FIG. 1 to see holding elements 7 by means of which the exhaust system 4 is held, in particular suspended, on the underfloor. Here, the holding elements 7 are formed for example as suspension elements and are also referred to as exhaust system suspension elements. In particular, the holding elements 7 are, at least in one subregion, formed from rubber, such that relative movements between the exhaust system 4 and the underfloor are dampened by deformation of the rubber.

The exhaust system 4 has a rear muffler 8 which can be flowed through by the exhaust gas and which is for example a rear muffler and is also referred to simply as muffler and which is used to dampen undesired noises. In a flow direction of the exhaust gas flowing through the exhaust system 4, the rear muffler 8 is adjoined by a tailpipe 9, through which the exhaust gas flows, of the exhaust system 4, wherein the tailpipe 9 is also referred to as exhaust pipe and opens into the surroundings 10. The exhaust gas flowing through the exhaust system 4 can thus flow via the tailpipe 9 into the surroundings 10, such that the tailpipe 9 is not adjoined by any further mufflers. In other words, in the flow direction of the exhaust gas flowing through the exhaust system 4, no further muffler is arranged downstream of the tailpipe 9. The tailpipe 9 is for example an exhaust pipe which can be flowed through by the exhaust gas.

Here, the exhaust system 4 also comprises an exhaust flap 11, which is illustrated in particularly schematic form in FIG. 1 and which has a valve element 12, which can be seen particularly clearly from FIG. 2. The valve element 12 is, in the exemplary embodiment illustrated in FIGS. 1 and 2, formed as a flap, and in this case as a butterfly flap or butterfly valve. Furthermore, the exhaust flap 11 has an actuator 13, by means of which the valve element 12 is movable, in particular pivotable. Here, the actuator 13 is formed as an electric actuator or as an electrically actuatable or operable actuator, and thus comprises at least one electric motor by means of which the valve element 12 can be moved. The actuator 13 is also referred to as electric exhaust flap adjuster, adjuster, flap adjuster or valve adjuster. By means of the actuator 13, the valve element 12 is—as will be discussed in more detail below—movable, in particular pivotable, between at least two mutually different positions, wherein the valve element 12 is in particular movable relative to the exhaust pipe (tailpipe 9). One of the positions is for example a closed position of the valve element 12, wherein the other position is for example an open position of the valve element 12. In the closed position, the valve element 12 shuts off at least a subregion of a flow cross section, which can be flowed through by the exhaust gas, of the exhaust system 4, preferably of the tailpipe 9, such that the exhaust gas cannot flow through the shut-off subregion. However, in the open position, the valve element 12 opens up the subregion, such that the exhaust gas can flow through the subregion. The tailpipe 9, or at least one length region of the tailpipe 9, may be a constituent part of the exhaust flap 11, such that the valve element 12 is for example arranged in movable, in particular pivotable, fashion in the length region. It can be seen particularly clearly from FIG. 2 that the tailpipe 9 has an opening 14, also referred to as tailpipe opening, via which the tailpipe 9 opens into the surroundings 10.

Exhaust systems are also conceivable in which the exhaust flap is seated upstream of the rear muffler (DE 10 2013 208 946 A1). In the concept, all of the tailpipes are then flowed through. Nevertheless, the same principle is provided whereby, when the flap is closed, the easier path (with less exhaust back pressure and less damping) for the exhaust gas is shut off.

The motor vehicle 1 furthermore comprises an electronic processing device 16, which can be seen particularly clearly from FIG. 1 and is schematically illustrated therein and which is assigned to the internal combustion engine 3 and is also referred to as engine control unit or engine controller. By means of the electronic processing device 16, which is also referred to as first electronic processing device, the internal combustion engine 3 is controlled in closed-loop fashion and thus operated.

As can be seen from FIG. 2, provision is normally made whereby the actuator 13 of the exhaust flap 11 is for example connected, in particular electrically, to the engine control unit (electronic processing device 16), and is thus attached to the engine control unit, via at least one line 15 or via a wiring harness which comprises at least the line 15. In particular, the engine control unit is designed to output electrical signals as electrical or electronic control signals, and to transmit these in particular via the line 15 to the actuator 13, which is designed to receive the control signals of the engine control unit. In this way, the actuator 13 is commonly, in particular at least substantially directly, activated by the engine control unit, whereby the valve element 12 is moved. Thus, the valve element 12 is moved by the engine control unit by means of the actuator 13. The above-described connection of the actuator 13 to the engine control unit is illustrated in FIG. 2 by an arrow 75.

Figure 3:
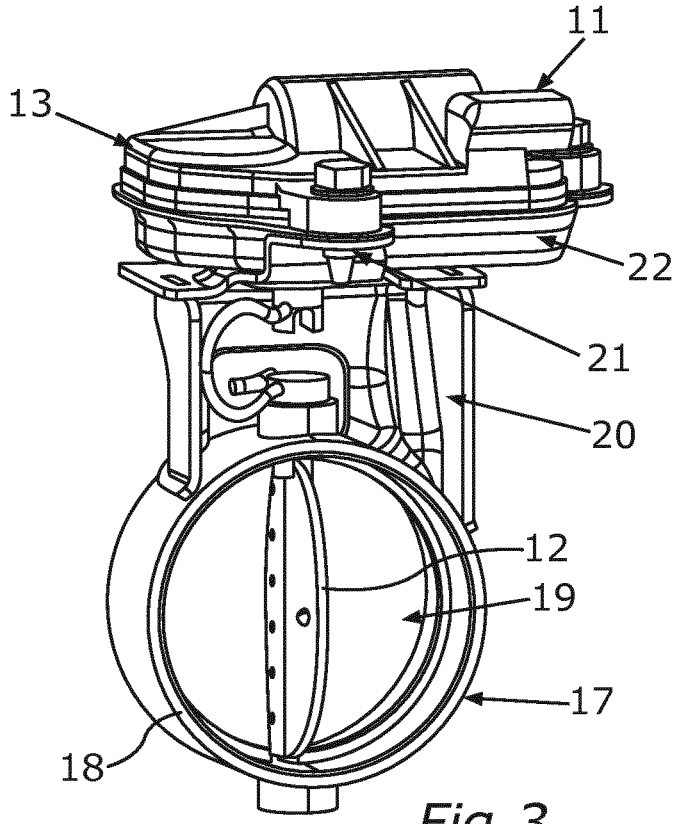
FIG. 3 shows a schematic perspective view of the exhaust flap.

FIG. 3 shows the exhaust flap 11 by way of example in a schematic perspective view. The above-stated length region in which the valve element 12 is arranged in movable, in particular pivotable, fashion is denoted by 17 in FIG. 3, and is formed for example by a pipe part 18 which can be flowed through by the exhaust gas. Furthermore, the flow cross section which can be flowed through by the exhaust gas and which can be at least partially fluidically shut-off and opened up by means of the valve element 12 is denoted by 19 in FIG. 3. The pipe part 18 is for example also referred to as exhaust flap part and is, in particular in the fully produced state of the motor vehicle 1, installed on the exhaust pipe (tailpipe 9). It is furthermore conceivable for the exhaust flap 11 to be arranged upstream of the tailpipe 9.

The pipe part 18 is connected to an installation bracket 20 which is formed for example as an installation plate and which has a screw preparation 21 for the actuator 13. By means of the screw preparation 21, the actuator 13 is connected, in particular screwed, to the installation bracket 20, such that the actuator 13 is connected by means of the screw preparation 21 and the installation bracket 20 to the pipe part 18. In this way, the exhaust flap 11 forms, for example, an easily handleable and installable module. Furthermore, a thermal insulation 22 is provided, by which, for example, the actuator 13 or electronic components and/or mechanical components of the actuator 13 is or are surrounded in order to thereby protect the components of the actuator 13 against excessive heat loading.

As can be seen from FIGS. 1 to 3, the exhaust flap 11 is commonly installed before or upstream of the final muffler of the exhaust system 4 and thus downstream of the rear muffler 8, in particular a short distance upstream of the opening 14. The exhaust flap 11, in particular the valve element 12, is possibly at least partially visible if, for example, a person looks through the opening 14 into the exhaust system 4. It is alternatively conceivable for the exhaust flap 11 to be arranged adjacent to or upstream of the rear muffler 8. It is also conceivable for the exhaust flap 11 to be installed in a central part of the exhaust system 4 in order, for example, to permit switchable crosstalk between at least two pipelines in a two-channel exhaust system. This arrangement of the exhaust flap 11 can have advantages with regard to functional noises. The further to the rear in the exhaust system the exhaust flap 11 is located, the more one will hear metallic impacts or possible flow noise as the exhaust flap 11 or the valve element 12 changes its position. Furthermore, as in the above disclosure, all tailpipes may be utilized, both when the exhaust flap is open and when it is closed. If the flap is installed upstream of the muffler, absorption may also be implemented downstream thereof, which can then reduce flow noise—possibly owing to a variable flap in intermediate positions—again.

Figure 4:
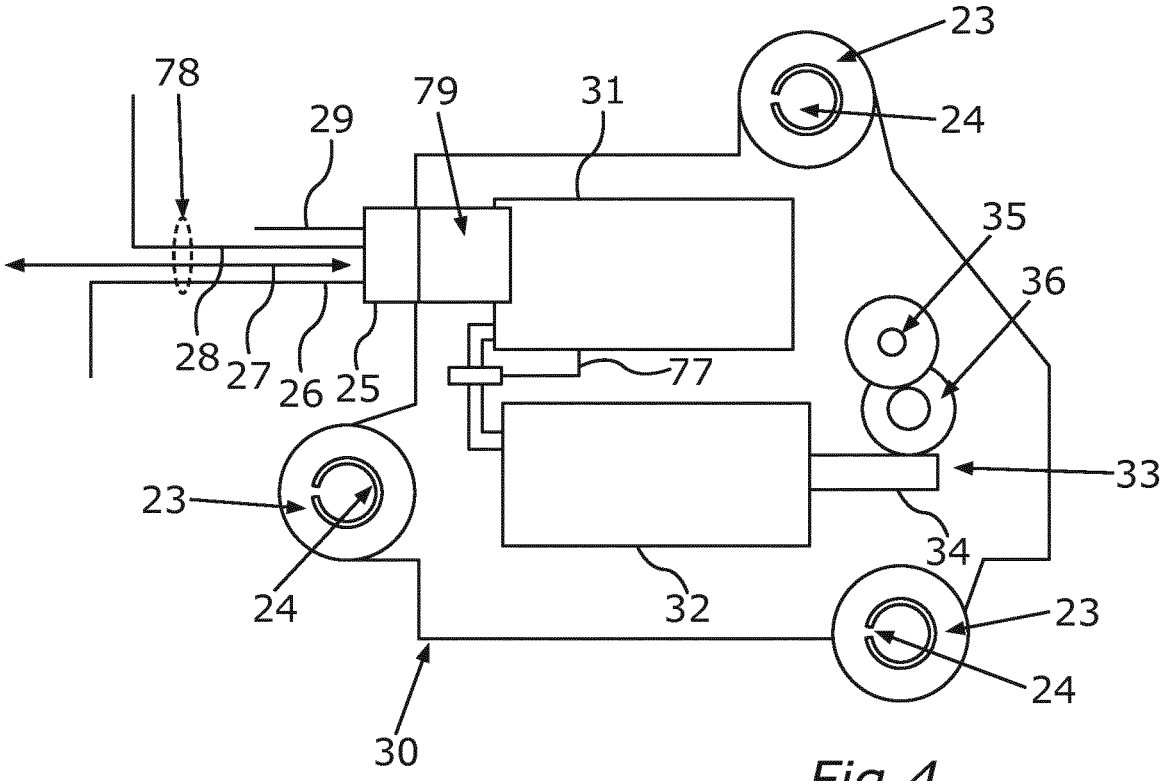
FIG. 4 is a schematic illustration of an electronic processing device of the exhaust flap according to a first embodiment.

FIG. 4 illustrates the actuator 13, in particular the electrical construction thereof, of the exhaust flap 11 according to a first embodiment. Here, the actuator 13 has a connector 79, also referred to as component connector or pin, and fastening lugs 23 by means of which the actuator 13 can be screwed together with the installation bracket 20. Here, the respective fastening lug 23 has a passage opening into which a slotted sleeve 24 composed of metal is inserted. Furthermore, it is also possible to see a connector 25, which is referred to as wiring harness connector and which is for example connected to the line 15 or is part of the line 15. The connector 25 is connected to the connector 79, whereby, for example, the connectors 79 and 25 are electrically connected to one another. In this way, the actuator 13 is electrically connected to the line 15 in order to be able to electrically connect the actuator 13 to the engine control unit via the line 15. Via a terminal 26, the connector 79 and thus the actuator 13 can be supplied with energy, in particular with electrical energy, such that, for example, the actuator 13 can be electrically connected via the terminal 26 to a voltage supply or to a voltage source of the motor vehicle 1. The voltage supply is for example a battery, wherein the voltage supply can for example provide a switched supply voltage.

The actuator 14 is an adjuster which has for example an electric motor, which, via a worm drive and gearing, or only gearing, can drive an adjustment axle in both directions in order to adjust the valve element 12. In order that this occurs in the simplest manner possible, the adjuster has electronics which correspondingly activate the motor if a corresponding command is received from a superordinate control unit. Here, by means of the motor current, the electronics detect whether the stops have been reached. At the same time, a time window is considered. Modern variants have a small encoder wheel installed, by means of which the positions between the stops can also be detected. Purely open/closed adjusters can thus likewise detect the stops. Modern adjusters utilize this additional component in order to then also move to intermediate positions, or perform continuous closed-loop control. The activation or the transmission of commands may be realized in a variety of ways. PWM, LIN etc. If a position sensor or situation sensor is already installed, the adjuster can then also make this information available again to the superordinate control unit, for example likewise via an additional PWM line or via the same LIN or bus line for the purposes of the activation.

Via a terminal 27, a signal connection to the engine control unit is realized, such that for example the actuator 13 and the engine control unit can exchange electrical signals via the terminal 27. In particular, the actuator 13 can receive the abovementioned control signals from the engine control unit by the terminal 27. Via a further terminal 28, the actuator 13 can be connected to the vehicle ground or to a corresponding support. In the exemplary embodiment illustrated in FIG. 4, a further terminal 29 is not used. The terminals 26, 27 and 28, or respective line elements which are connected to the terminals 26, 27 and 28, are combined to form the abovementioned wiring harness, which is denoted by 78 in FIG. 4, and the connector of which is denoted by 25 in FIG. 4.

Furthermore, the actuator 13 has a housing 30, which is formed for example from a plastic. The housing 30 comprises, for example, a bottom shell and a top shell which is connected to the bottom shell.

The connector 79 is for example connected, in particular electrically, to a circuit board 31 with control electronics, wherein the circuit board 31 is accommodated in the housing 30 and is a constituent part of the actuator 13. Here, the control electronics form, for example, a microcontroller. Furthermore, the circuit board 31 may have power electronics, which comprise in particular a H-bridge. The abovementioned electric motor is an electric machine and is denoted by 32 in FIG. 4. It can be seen from FIG. 4 that the electric motor 32 can be activated by the microcontroller in order to thereby move the valve element 12 by means of the electric motor 32. For this purpose, the electric motor 32 comprises a stator and a rotor 33, which is rotatable relative to the stator about an axis of rotation. The rotor 33 has a rotor shaft 34, by means of which a gearing unit 36 of the actuator 13 can be driven by the electric motor 32. Via the gearing unit 36, a drive axle 35 of the valve element 12 can be driven by the electric motor 32, in order to thereby pivot the valve element 12, in particular relative to the pipe part 18. In order to drive the valve element 12, and thus move, in particular pivot, the latter relative to the pipe part 18, by means of the electric motor 32, the electric motor 32 is supplied with electrical energy or an electrical current. This electrical current with which the electric motor 32 is supplied in order to move the valve element 12 in the described manner can be detected, and thus measured, by a current measuring means 77 illustrated in particularly schematic form in FIG. 4. For this purpose, the current measuring means 77 comprises, for example, at least one sensor for detecting the current with which the electric motor 32 is supplied in order to move the valve element 12.

The engine control unit is for example a superordinate controller from which the actuator 13, in particular the electric motor 32, receives, via the line 15 formed as signal line, a command or an instruction for opening or closing the valve element 12. The line 15 is for example the line element which is connected to the terminal 27, such that the actuator 13, in particular the microcontroller, receives the abovementioned command or the abovementioned instruction for opening or closing the valve element 12. The actuator 13, also referred to as adjuster, then independently executes the command. As soon as the adjuster thus receives a position demand as a command from the engine control unit, the electric motor 32, and via this the valve element 12, are set in motion if the position demand characterizes a position or a setting which differs from the present setting or from the present position of the valve element 12. Here, for example, the microcontroller (μC) activates the H-bridge such that the electric motor 32 formed for example as a DC motor, or the rotor 33 thereof, rotates in the correct direction in order to move, in particular pivot, the valve element 12 from its present position into the position characterized by the position demand. If the electric motor 32 and thus the valve element 12 are set in motion, then during this time a start-up current with which the electric motor 32 is supplied is measured. At the same time, a timer is started, which is also referred to as counter or time counter.

The valve element 12, formed for example as a flap, now moves with an at least substantially constant speed into the position characterized by the position demand, in particular into an opposite stop. If the exhaust flap 11 is for example formed as a simple open-closed flap, then the valve element 12 can be moved only exactly into the two positions, such that the respective position is an end position. The end position is also referred to as end stop or stop, such that the valve element 12 can be moved only exactly into the respective end positions but not beyond these, and in particular can be held in the end positions but not in intermediate positions arranged between the end positions. If the valve element 12 reaches its end position, then the valve element 12 can be moved no further by means of the electric motor 32, such that the electric motor 32 or the rotor 33 can move no further. This simultaneously leads to a blocking current or to a short-circuit current, which can be detected by means of the current measuring means 77. The blocking current or short-circuit current is a rising electrical current which, in particular by virtue of the fact that the blocking current is detected by the current measuring means 77, can be utilized by the microcontroller as identification of a stop. In other words, the microcontroller can identify on the basis of the detected blocking current that the valve element 12 has reached its end position.

For this purpose, for example, the microcontroller compares the blocking current with the start-up current, in particular taking into consideration the running time determined by means of the timer. The blocking current is higher than the start-up current. The running time characterizes for example a period of time extending from a point in time at which the timer is started to a point in time at which the blocking current is measured. The blocking current and the running time are values on the basis of which the microcontroller or the adjuster can identify whether the valve element 12 has reached the desired end position in the first place, that is to say may be at the stop, which may be the case in particular only if the running time has reached or overshot a minimum value. Furthermore, the adjuster can identify, on the basis of the values, whether the valve element 12 has become stuck before reaching the end position and has thus not reached the end position, in particular if the blocking current is detected before the running time has reached its minimum value. In this way, the adjuster can also detect that the valve element 12 is adjustable only in a very sluggish manner, which can indicate excessive wear and/or excessive fouling and/or damage.

This is the case in particular if the running time overshoots a maximum value, that is to say an excessively long time is required to move the valve element 12 into the end position. A fault can consequently be detected. Such fault events, and further fault events, are transmitted to the superordinate controller (engine control unit), for example by virtue of the signal line being connected to ground for a defined time. Larger controllers in the automotive sector thus detect short-circuits to ground in the wiring harness 78. For example, the signal line is connected to ground only for a defined period of time of for example five seconds. In this way, the superordinate controller can distinguish between wiring harness and adjuster problems. Such adjusters with integrated intelligence have the advantage that they can be incorporated relatively easily into a different number of superordinate controllers. For this purpose, the superordinate controller must merely provide a single output pin which can for example output a PWM signal with the corresponding frequency and the corresponding pulse-interval ratio (PWM—pulse width modulation). In the case of such electrical exhaust flap adjusting means, it is also possible for the correct functioning of the adjuster to be diagnosed. For example, if the adjuster or the valve element 12 does not reach the respective end positions or stops in a predefined time, or if the adjuster is no longer connected to the engine controller, this can be identified by means of an internal fault or performance diagnosis. Modern adjusters with internal position detection can be monitored even more effectively. Only pneumatic systems can be diagnosed only as far as the electrical switchover valve. In the case of these systems, if an exhaust flap becomes jammed, this cannot be identified by the engine controller. The switchover valve also receives only an electrical information item which signifies open or closed. This can likewise be used for the auxiliary control unit in order to then subsequently control switched or closed-loop-controlled exhaust flaps on another exhaust system.

Figure 5:
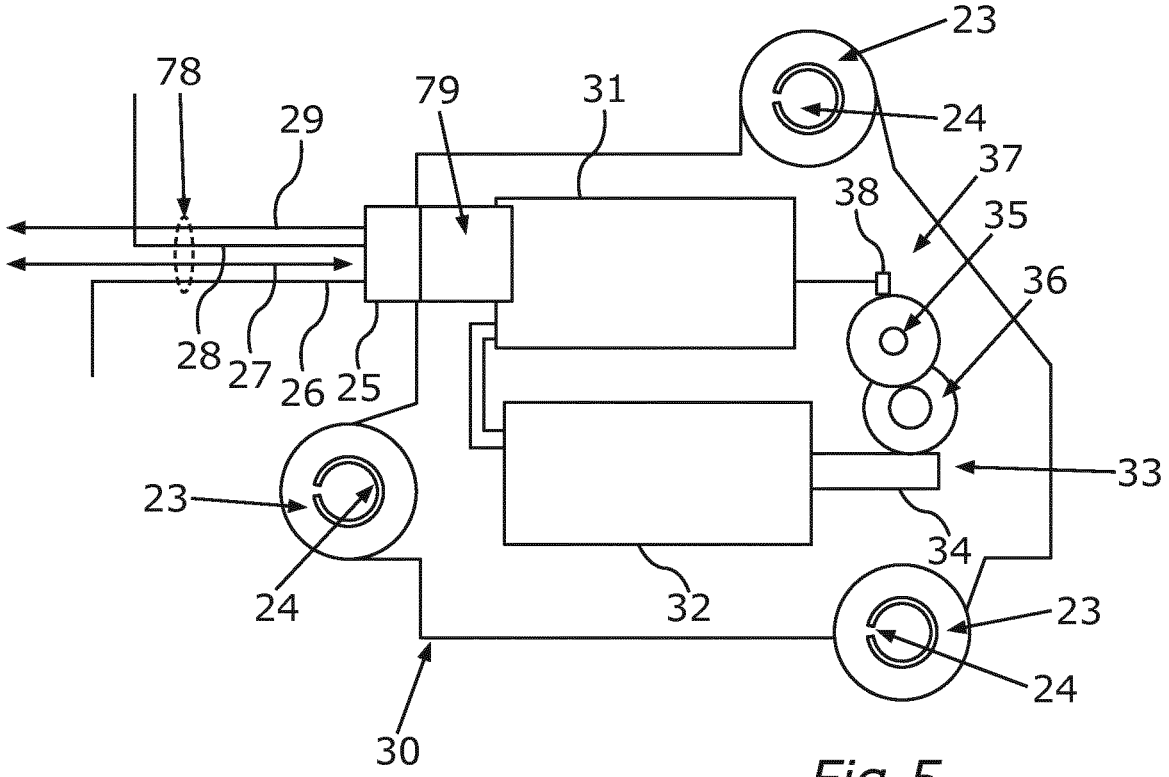
FIG. 5 is a schematic illustration of the electronic processing device of the exhaust flap according to a second embodiment.

FIG. 5 illustrates a second embodiment, in which a position detecting means 37 is provided. The position detecting means 37 comprises at least one position sensor 38, which is also referred to as situation sensor. By means of the position sensor 38 and thus by means of the position detecting means 37, also referred to as position identifying means, at least one position of the valve element 12 can be at least indirectly identified or detected. In other words, by means of the position detecting means 37, respective positions or settings into which the valve element 12 is movable by means of the actuator 13 can be at least indirectly detected. This detection of the respective position of the valve element 12 is also referred to as position detection or position identification and is performed in the present case on the basis of the drive axle 35. In particular, it is possible by means of the position sensor 38 for respective rotational positions of the drive axle 35 to be detected, such that, on the basis of the respective detected rotational position, the respective setting or position of the valve element 12 can be detected, because the respective rotational position of the drive axle 35 corresponds to a respective position of the valve element 12.

In the embodiment illustrated in FIG. 5, the terminal 29 is used, wherein, for example, at least one line element is electronically connected to the terminal 29. Via the terminal 29, the position of the valve element 12 determined by the position detecting means 37 is for example fed back to the engine control unit, such that position feedback can be realized in this way.

Altogether, it can be seen that the exhaust flap 11 is formed as an electrical exhaust flap system. There are numerous reasons for the use of such electrical exhaust flap systems. As a producer of the motor vehicle 1, it is for example sought, through the use of such electrical exhaust flap systems, to prevent undesired, unpleasant and/or excessively loud pass-by noises, and to comply with corresponding requirements and, at the same time, offer a sporty noise, in particular pass-by noise, to the driver of the motor vehicle 1 and/or to persons present in the surroundings 10 in certain driving states, without being excessively loud. Without the use of such exhaust flaps, it would be necessary for the exhaust flap 11 to be constructed such that it always exactly complies with pass-by noise type testing. Noise damping in an exhaust system however always has the adverse effect on the exhaust back pressure, which is increased as a result of noise damping. With increasing exhaust mass flow, an increasing exhaust back pressure can have an adverse effect on the power and the fuel consumption. Specifically in the upper engine speed/load range, this exhaust back pressure rises to an extreme degree in exhaust systems without an exhaust flap.

Noises emitted by the motor vehicle 1, in particular the internal combustion engine 3, for example via the exhaust system 4 and in particular via the opening 14, to the surroundings 10 are determined for example during the course of a pass-by noise measurement. The pass-by noise measurement is performed for example in a launch mode of the motor vehicle 1. The motor vehicle 1 or the internal combustion engine 3 is in this case started, and no drive mode switch etc. in the motor vehicle 1 is actuated. Under this condition, a pass-by is performed under acceleration on a noise measurement track. This track is for example entered at 50 kilometers per hour, and full-load acceleration is then performed. In the case of a vehicle with manual transmission, this is normally performed in the third gear ratio, and is performed in the second gear ratio in the case of relatively low-powered vehicles. In vehicles with automatic transmissions, the corresponding automatic mode is used. The above paragraph relates in particular to an old regulation regarding the emission of noises.

Below, a rough description will be given of a new regulation, for example the pass-by noise regulation R51.03. In other methods for pass-by noise measurement, in particular in the context of the new regulation, a distinction is for example no longer made between vehicles with manual transmission and automatic transmission. The pass-by noise measurement is performed in one or two fixed gear ratios. What is crucial for the gear ratio used for the measurement is the acceleration realized on the measurement track. The specification is approximately two meters per second squared. Here, on the measurement track, the speed of 50 kilometers per hour must be attained in the region of the microphone. Additionally, the track must then be driven through in the same gear ratio at a constant speed of 50 kilometers per hour. From both the determined sound intensity values, a value is calculated which must lie below a particular threshold value. These new measurement systems are intended to provide equal opportunities and reproducibility. Depending on whether a pass-by under acceleration must be determined using one or two gear ratios, a value is mathematically determined from the determined levels and the levels of constant-speed travel at 50 km/h in the same gear ratios. This calculated value must lie below a legal specification.

A further method for pass-by noise measurement is referred to as ASEP or the ASEP method, which will also be referred to simply as test or ASEP test. In this test, a level run-up curve is determined in different gear ratios at different engine speeds. This determined level run-up must be determined in different gear ratios for all drive mode settings. Which gear ratios and which rotational speeds are determined from formulas and from the drive-in engine speeds of which the vehicle is actually capable.

Here, these level curves must lie below a defined limit or envelope curve, which is calculated from a formula and the loudest point during the pass-by. It is thus intended to ensure that no function downstream of the exhaust flap application is applied which closes the exhaust flap only during the pass-by noise measurement. It is also sought in this way to prevent noise damping no longer being present in certain modes or in sportier settings. It is thus sought to ensure that the exhaust flap control is reproducible, and that, in certain ranges between the different sport modes, the level difference lies in certain tolerable limits. For example, if a vehicle has a separate switch by means of which the exhaust flap 11 or the valve element 12 can be opened and closed, then the vehicle must pass the test in the launch mode and thereafter in the ASEP test with the exhaust flap (valve element 12) closed and open. In such a case, the level with the exhaust flap open may be higher in the test, but only in the admissible limits. By contrast to the old legislation, it would now be necessary or possible for damping to be present even when the exhaust flap is open. Since the test must however be determined only in certain gear ratios and at certain engine speeds, this would then in turn have disadvantages at relatively high engine speed, in particular with regard to the fuel consumption. If the delta between open and closed is made too extreme, then it may be the case that the exhaust flaps must always close throughout the entire ASEP range. Consider a vehicle in the sport mode, in the case of which the exhaust flaps are always closed up to for example 4000 rpm in the 2nd, 3rd and 4th gear ratios. The sporty nature is lost. To prevent this effect, it is thus necessary to increase the damping for the flap-open range, but one thus also reduces the potential for the range outside that for the approval.

Specifically in the accessory trade sector, which is also referred to as the after-sales sector, in the past, accessories have been marketed by means of which the exhaust flap can be controlled in a manner unhindered by the manufacturer application. Such systems have the greatest effect if the vehicle manufacturer installs only exhaust systems without an exhaust flap. In such cases, exhaust systems with additional exhaust flaps have then been installed. With an external operator control device, the respective exhaust flap, or the valve element thereof, can then be opened or closed as required. In the launch mode, the systems initially close the exhaust flap, such that they can realize a corresponding pass-by level in accordance with the type test regulation. By simple actuation of a switch, the exhaust flap can then be opened and closed again. After a restart or after a shut-down of the internal combustion engine, the exhaust flap is then always moved back into its initial state again and thus closed, such that conformity with pass-by noise regulations can be established.

Such systems are normally switch systems which are connected to the electrical exhaust flap adjuster or to the electrical switchover valve of pneumatic systems. Such systems operate either with direct electrical lines or by radio, and utilize for example WLAN, Bluetooth and/or other wireless radio connections in order to be able to activate the adjuster by means of the switch system. The use of radio in particular permits easy retroactive installation.

Specifically relatively new procedures greatly restrict the free configuration of pass-by noise. The exhaust flap can now no longer be held open constantly outside the launch mode. In all drive modes in which the ASEP test must be performed, a closed exhaust flap is required, in particular in a manner dependent on the exhaust system construction. The only exception would be if the entire exhaust system were constructed such that the noise can be kept adequately low when the exhaust flap is open. This is however not particularly realistic, because then the vehicle could only be switched to be quieter by means of a corresponding exhaust flap switch, and furthermore, the exhaust back pressure would increase to an extreme degree. It is thus no longer possible for the exhaust flap to be opened fully over all gear ratios and the entire engine speed and load range, which can have a hard economic impact in particular on the sellers of accessory exhaust systems. It is basically not particularly complex to create an accessory exhaust system which, with an exhaust flap closed, satisfies legal pass-by noise regulations and, with the exhaust flap open, is louder than a series exhaust system. It is particularly difficult to construct an exhaust system which sounds completely different, performs the same control and thus passes the test procedure in the same ranges and furthermore, if it has a particle filter, still has the same exhaust back pressure in certain ranges. In the normal situation, the seller of such an exhaust system utilizes a series exhaust flap controller, because this, in most cases, closes the exhaust flap during the pass-by noise measurement. However, what can still work during the acoustic measurement of the pass-by under acceleration cannot apply to the ASEP test. An exemplary calculation for how the abovementioned ASEP level envelope curve can be calculated will be discussed below. What is crucial is the maximum level attained during the pass-by under acceleration. This initial point provides the anchor point for a regression line that is to be expected. In this case, this is the level to be expected with increasing engine speed. The gradient is, according to the legislation, predefined by the formula 5+1 dB(A)/1000 rpm. In relation to this curve, a limit curve is shifted which is likewise calculated in accordance with the legislation specifications. Maximum admissible level: D=Llimit−Lurban+2 dB(A)=>D=75 dB(a)−71.8 dB(A)+2 dB(A)=B=5.2 dB(A).

In different gear ratios, it is now necessary to determine a level run-up curve by measurement being performed at microphone height from low engine speeds under full load in the respective gear ratio with different engine speeds. To limit the effort involved here, too, the legislation limits itself to a particular range. Thus, for example, only the third gear ratio and the fourth gear ratio must be considered for the ASEP measurement.

Whilst, at the different engine speeds with a closed exhaust flap (L_VL_TEST_KLAPPE ZU), all level points lie below the limit curve (L_LIMIT), this does not apply to an open exhaust flap (L_VL_TEST_KLAPPE AUF). Only the final interpolation point at 3000 revolutions per minute lies below the limit curve. To achieve maximum acoustic sportiness in the series application in the sport and sport+ modes, the series application would thus be as follows: close exhaust flap in the third and fourth gear ratios up to approximately 2800 revolutions per minute, and open exhaust flap above approximately 2800 revolutions per minute. Specifically this latter interpolation point will presumably pose problems for the sellers of accessory exhaust systems.

Figure 6:
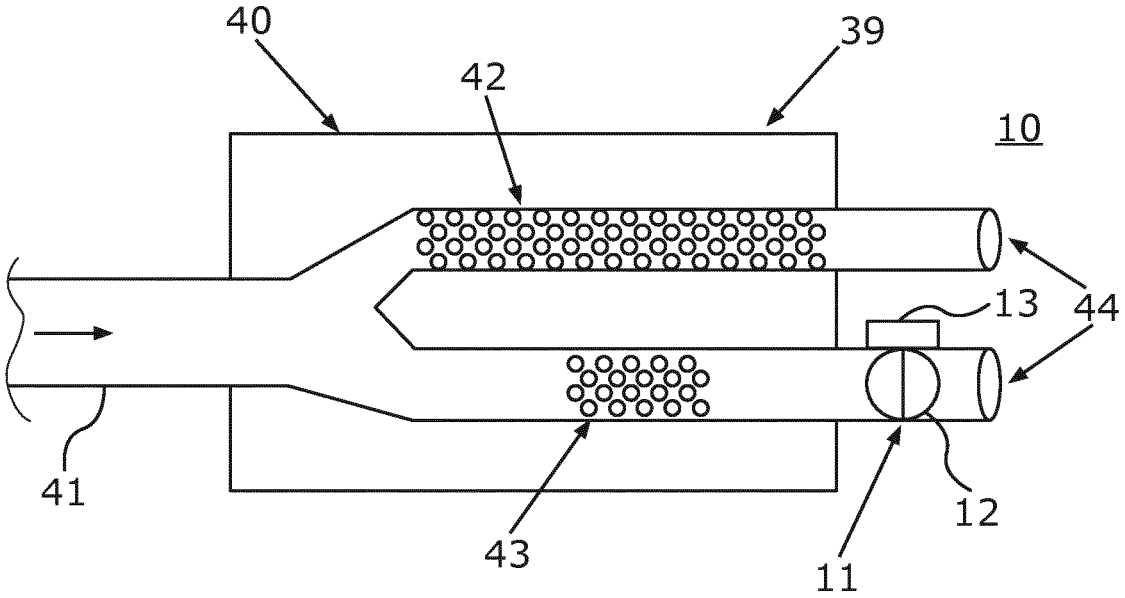
FIG. 6 shows, in a detail, a schematic plan view of the exhaust system according to a first embodiment.

This will be illustrated on the basis of the following description. Here, FIG. 6 shows a schematic plan view of a series rear muffler 39, which has a rear muffler housing 40 and an exhaust pipe 41 extending from the internal combustion engine 3. The exhaust pipe 41 leads into the series rear muffler 39 or into the rear muffler housing 40 thereof, and branches in the rear muffler housing 40. In FIG. 6, 42 denotes a first path which can be flowed through by the exhaust gas, whereas 43 denotes a second path which can be flowed through by the exhaust gas. The exhaust pipe 41 branches into the paths 42 and 43 in the rear muffler housing 40. Here, the path 42 has greater acoustic damping than the path 43, which is realized for example by perforation and/or by other means such as for example reflection chambers and/or cross-sectional reduction. The path 43 is the path or branch which has less damping, that is to say which is louder, which is realized for example directly by means of less perforation and/or by means of cross-sectional optimization. The path 42 acts only when the path 43 is shut off by the exhaust flap 11 or the valve element 12. If the exhaust flap is open, the path 43, that is to say the loud branch, is dominant. Here, the exhaust flap 11 is assigned to the path 43 or is arranged in the path 43, such that the path 43 can be opened up and shut off as required by means of the exhaust flap 11. For example, in the closed position, the path 43 is fluidically shut off, such that the exhaust gas does not flow, or flows only to a very small extent, through the path 43, and flows at least predominantly or entirely through the path 42. In the open position, however, the exhaust flap 11 opens up the path 43, such that the exhaust gas then flows through both paths 42 and 43.

Furthermore, in FIG. 6, tailpipe openings of the series rear muffler 39 are denoted by 44, such that the exhaust gas can flow out of the series rear muffler 39 to the surroundings 10 via the tailpipe openings 44. The series rear muffler 39 will also be referred to simply as rear muffler or muffler. Through the use of the exhaust flap 11, the series rear muffler can, in particular under full load, generate two opening level curves, leading to a respective noise that is acoustically perceptible to a person present in the surroundings 10.

Figure 8:
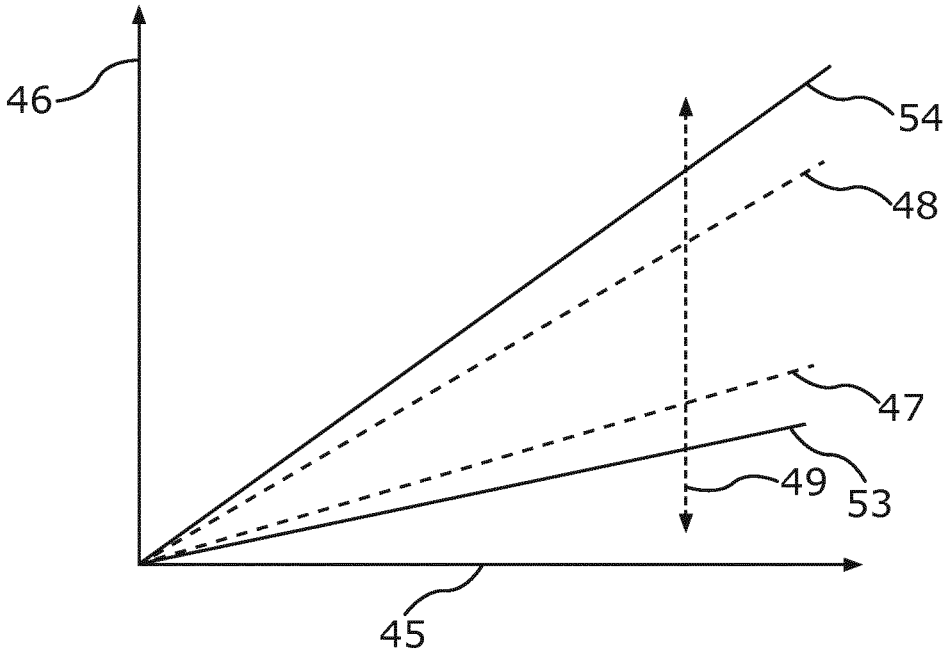
FIG. 8 shows a diagram for illustrating the sound intensity of a noise as a function of different boundary conditions.

The respective noises of the opening level curves differ for example in terms of their sound intensity. Here, FIG. 8 shows a diagram, on the abscissa 45 of which a parameter such as for example the engine speed (n) or the load (M) of the internal combustion engine 3 or the exhaust mass flow (Ams) is plotted. Plotted on the ordinate 46 of the diagram are for example the opening level, which for the sake of simplicity is illustrated in linear form, and thus the sound intensity of the respective noise. A course 47 illustrates for example the noise or the sound intensity thereof in the case of a closed exhaust flap 11 or in the case of a closed valve element 12 versus the increasing parameter, that is to say versus the increasing engine speed or the increasing load. A course 48 illustrates the noise versus the increasing parameter in the case of an open exhaust flap 11 and in the case of an open valve element 12. Furthermore, in FIG. 8, a double arrow 49 illustrates the exhaust back pressure. It can thus be seen from FIG. 8 that the exhaust back pressure is higher in the case of a closed valve element 12 than in the case of an open valve element 12. Depending on the damping of the paths 42 and 43, in the case of an open exhaust flap 11 or in the case of an open valve element 12, one obtains the course 48 which represents one level curve, and in the case of a closed exhaust flap 11 or in the case of a closed valve element 12, one obtains the course 47 which represents a further level curve, in particular at the respective tailpipe opening 44. If the valve element 12 is closed, damping is provided only by the path 42, which is designed with greater absorption, that is to say with greater damping, in relation to the path 43. Then, the damped path 43 is closed by means of the exhaust flap 11. This fact also ensures in most cases that, in the case of a closed exhaust flap 11, the exhaust back pressure increases versus the parameter, that is to say versus the engine speed n, versus the torque M or with increasing exhaust mass flow Ams, such that the above-stated parameter may also encompass the exhaust mass flow. In this case, the damping by means of absorption is highlighted. More or less absorption does not have a very great influence on exhaust back pressure. If further methods are used for the damping—which are difficult to illustrate here—such as cross-sectional reduction, reflection chambers, longer pipe lengths etc., then this has a significant influence on the exhaust back pressure.

Figure 7:
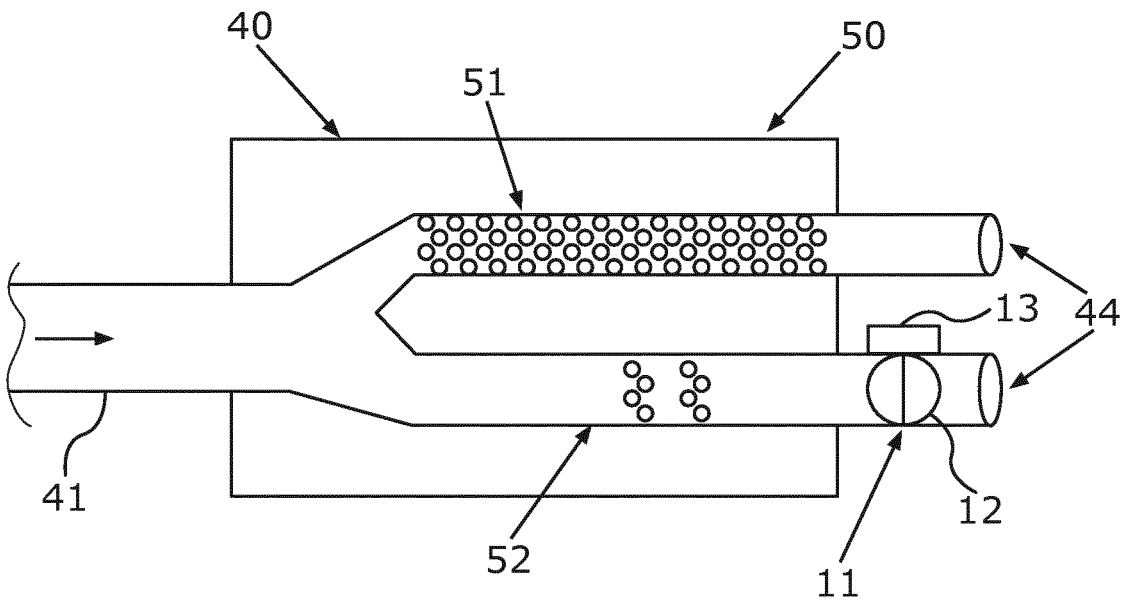
FIG. 7 shows, in a detail, a schematic plan view of the exhaust system according to a second embodiment.

FIG. 7 shows, in a schematic plan view, a rear muffler 50 which is formed for example as an accessory rear muffler and which likewise has an exhaust pipe 41 and a rear muffler housing 40 in which the exhaust pipe 41 branches into paths 51 and 52. In the case of the rear muffler 50, too, the path 51 in the present case has greater acoustic damping than the path 52, and here, it is for example the case that the path 51 has the same damping as the path 42. In other words, it is for example the case that the past 51 has the same acoustic damping or damping action as the path 51, or the path 51 has greater damping than the path 42, also referred to as series branch. It is highly unlikely that an after-sales exhaust system with a different construction in the remaining branch (undamped branch is shut off by exhaust flap) has identical damping to the series exhaust system. The damping is presumably slightly greater or less. In this example, more damping. The same applies to the exhaust back pressure characteristics if the construction is—not as in this example—completely different. This value may thus also lie above or below the series configuration in the same operating situation.

The path 52 has for example no damping, or the damping thereof is reduced to a minimum, such that the path 52 dampens the noise to a lesser degree than the path 43. To thus realize an acoustic difference in relation to the series exhaust system, the damping of the paths 51 and 52 is configured differently than the damping of the paths 42 and 43. Depending on the damping of the paths 43 and 52, one obtains, for example in the case of a closed valve element 12, a level curve illustrated in FIG. 8 by a course 53 and, in the case of a closed valve element 12, a level curve illustrated in FIG. 8 by a course 54, in particular at the respective tailpipe opening 44. The same applies to the characteristic of the exhaust back pressure. In the example, the courses are illustrated linearly for the sake of simplification. In reality, the course exhibits considerable elevations and, in part, drops. In different exhaust systems, the elevations and depressions in the level are or may be situated at entirely different engine speed/load ranges. In the case of a closed valve element 12, damping is provided only by the path 51, possibly with more intense or greater absorption than the path 42. In the case of such an accessory part, ideally exactly the same damping should be achieved as in the case of the series exhaust system in order that a similar level is realized in the pass-by measurement. To realize this in terms of construction is however very complex. In most cases, this fact also has the effect that, in the case of a closed valve element 12, the exhaust back pressure increases versus the engine speed n, the torque M or with increasing exhaust mass flow Ams, or may even be greater than in the case of the series exhaust system. In the abovementioned example, the damping of the rear muffler 50, formed for example as an accessory solution, in the case of a closed exhaust flap 11 lies slightly below the damping of the series rear muffler 39 formed for example as a series part. It is however exactly the opposite situation when the exhaust flap 11 is open. The level of the rear muffler 50 lies considerably above that of the series rear muffler 39. This is exactly the aim of the retrofit exhaust system, which is thus intended to have greater acoustic presence than the series exhaust system. This embodiment of the retrofit exhaust system is however counteracted by the ASEP test.

The level course, which has much greater presence, of an after-sales exhaust system in the case of open exhaust flaps becomes a problem in the ASEP test if even the series exhaust flap application does not pass this. The statements above and below illustrate the ASEP test in highly simplified form. In the above example, on the basis of an ASEP measurement, it has been shown that the series exhaust system can open the exhaust flaps above approximately 2800 revolutions per minute in the sport and sport+ modes in the third and fourth gear ratios. This is also only the case because the measurement with the exhaust flap open has resulted in a level below the calculated limit curve. If, for example, a retrofit exhaust system, also referred to as after-sales exhaust system, with the considerably higher level course in the case of an open exhaust flap 11 as presented above is now installed, then an approval measurement will be unsuccessful in specifically this range. Even if the damping curve in the case of a closed exhaust flap 11—as has been shown in the example—lies below the series exhaust system, problems may arise. If the normal pass-by measurement is measured as being relatively quiet, then this simultaneously reduces the limit value curve for the ASEP test. If, in the case of the base measurement, that is to say the pass-by under acceleration, with an exhaust system that exhibits relatively intense damping, too great a safety margin in relation to the limit value is created, then this also has an effect on the limit value curve in the ASEP test. The quieter the pass-by, the less level potential exists in the ASEP test. It is thus almost impossible to replace series exhaust systems with retrofit solutions. This is the case in particular if the series application is to be adopted for the exhaust flap.

One possibility for solving this problem is to use not switched but closed-loop-controlled exhaust flaps. A switched exhaust flap is to be understood to mean an abovementioned open-closed exhaust flap, the valve element of which can be moved only into exactly two positions and can be held only in exactly these two positions. A closed-loop-controlled exhaust flap is to be understood to mean an exhaust flap whose valve element can be moved not only into the abovementioned positions but also into multiple further positions, and held in these multiple further positions, wherein these multiple further positions are for example intermediate positions which lie between the aforementioned positions, that is to say in particular between the closed position and the open position. In particular, it is for example possible here for the valve element 12 to be moved in continuously variable fashion between the end positions, and thus moved in continuously variable fashion into positions situated between the end positions, and held in the positions, such that, for example, the flow cross section 19 that can be flowed through by the exhaust gas can be set in continuously variable fashion, in particular between end positions. Such a closed-loop-controlled exhaust flap is also referred to as an exhaust flap which is adjustable over the angle. Even if, in the case of a series exhaust system, use were made of exhaust flaps which are adjustable over the angle, such a control unit, including function, would presumably be required in order to permit an opening angle alignment. An adaptation of the characteristic maps directly in the engine control software would then duly also be conceivable. This is however highly complex and must be allowed for. Either by means of stored coding variants or additional databases. The outlay and the costs are very high and are therefore commonly avoided.

Figure 9:
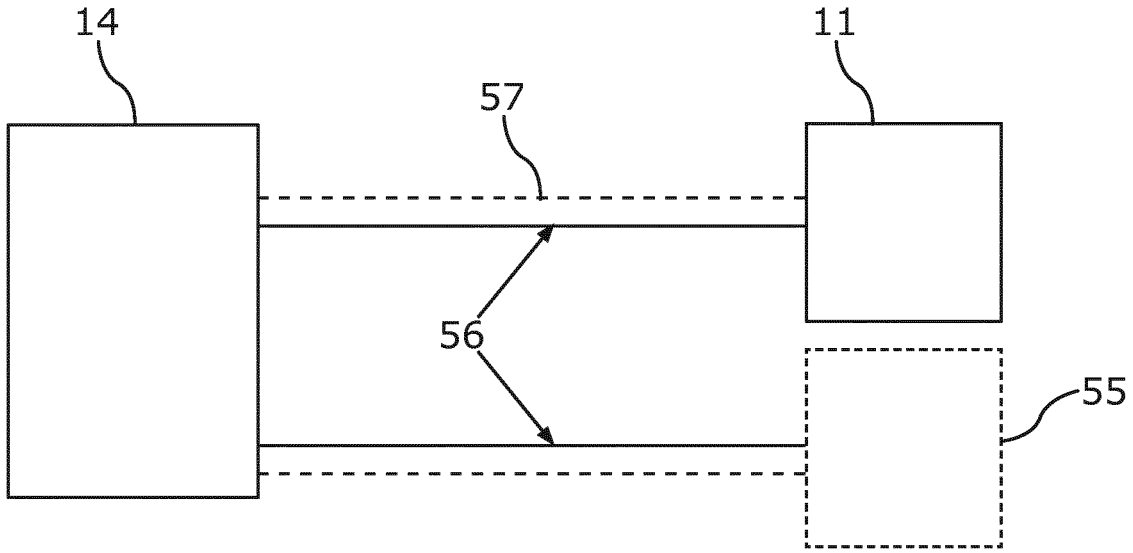
FIG. 9 is a schematic illustration for illustrating an operation of exhaust flaps.

FIG. 9 illustrates, for example, a series exhaust system, the exhaust flap 11 of which is illustrated in particularly schematic form in FIG. 9. Furthermore, a further exhaust flap denoted by 55 is optionally provided, wherein the statements above and below relating to the exhaust flap 11 may also be readily transferred to the exhaust flap 55, and vice versa. The abovementioned signal line, which is for example connected to the terminal 27, will also be referred to as control line, and is denoted by 56 in FIG. 9. The control line 56 will also be referred to as activation line. It can be seen from FIG. 9 that the exhaust flap 11 or 55 is electrically connected at least substantially directly to the engine control unit (electronic processing device 16) via the respective control line 56. The abovementioned situation feedback, which is also referred to as position feedback, is performed via a feedback line 57. The activation line can transmit various information items in order to activate various systems:

With a simple high or low level on the activation line, it is for example possible for an electromagnetic switchover valve to be activated, which in turn switches a vacuum capsule and the exhaust flap installed thereon, or the valve element 12.

With two activation lines, it is also possible for an electric motor installed in the exhaust flap adjuster to be directly driven. The power output stage is in this case installed in the engine controller and the adjustment position can be regulated by means of the fed-back position-situation feedback.

By means of an activation line, an intelligent exhaust flap adjuster can be controlled in open-loop or closed-loop fashion. Either by means of two simple pulse-interval ratios for "open" and "closed" or by means of a complete pulse-interval band over the full opening angle. Position feedback may be realized in this case via a separate line. Fault diagnostics can be performed both via the control line and via the position feedback line.

The latter variant may also be realized via LIN or CAN instead of PWM.

It would however also be possible for the lines 57 and 56 to be composed of one line, for example LIN bus. In the case of the LIN bus, the two adjusters may then also be connected to the one bus and distinguished by means of different ID.

Irrespective of the adjuster used in the series exhaust system, a technology for being able to manipulate or correct the opening level is required for the retrofit sector, that is to say for the after-sales sector. It has been found that this can be realized in particular by means of closed-loop-controllable exhaust flaps, or exhaust flaps which are adjustable over the angle or opening angle, that is to say by means of elements by means of which an exhaust pipe can be not only simply closed and opened but rather by means of an element which makes it possible for these two states to be transitioned into one another in continuous fashion. Provision is thus preferably made whereby the valve element 12 can be moved in at least substantially continuous or continuously variable fashion between the end positions and into respective positions arranged between the end positions, and held in the positions. In this way, the valve element 12 functions as a valve which can reduce or widen the flow cross section 19 of the pipe part 18, in particular the diameter thereof, in continuously variable fashion. In other words, by means of the valve element 12, which is movable in continuously variable fashion between the end positions, it is possible for the flow cross section 19 to be adjusted in at least substantially continuously variable fashion, or for respective values of the flow cross section 19 to be set in continuously variable fashion, and for these values to be held.

Figure 10:
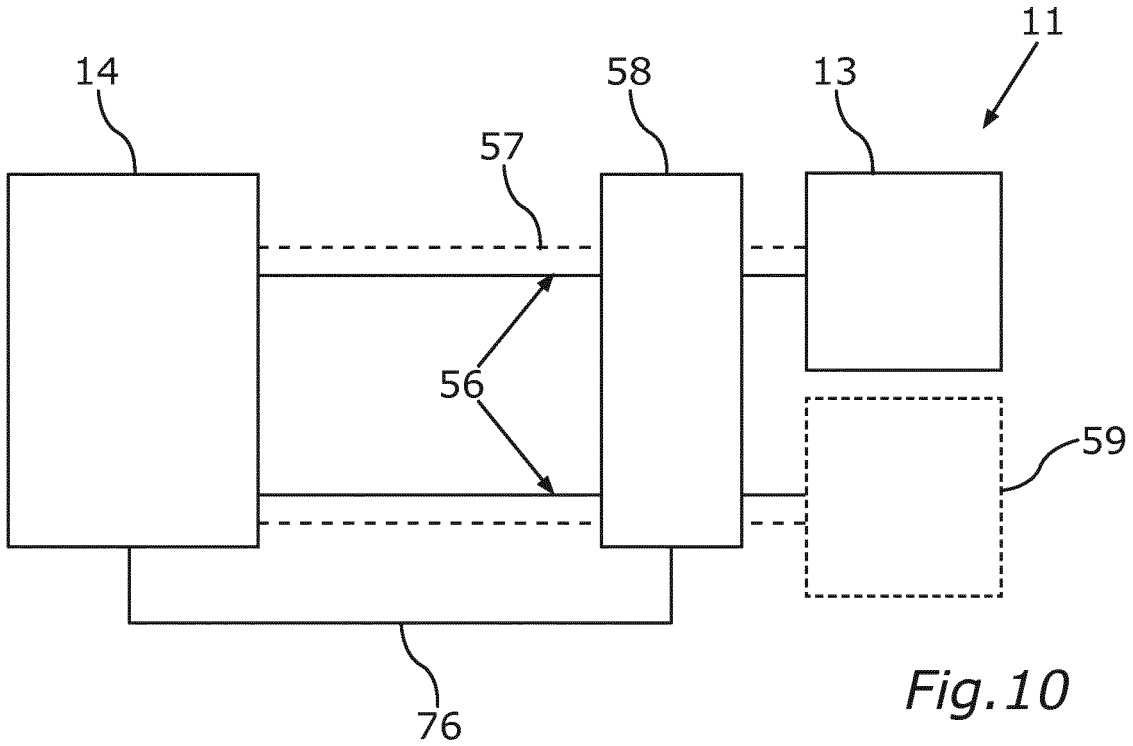
FIG. 10 is a schematic illustration for depicting an operation of the exhaust flap according to the invention.

To be able to advantageously use this also for retrofit solutions and thus in the after-sales sector in a simple manner, provision is made whereby the exhaust flap 11—as can be seen from FIG. 10—has a dedicated electronic processing device 58, which differs from or is provided in addition to the electronic processing device 16 and which will also be referred to as auxiliary control unit or flap control unit. The attribute "dedicated" relating to the electronic processing device 58 of the exhaust flap 11 is intended to illustrate that the flap control unit (electronic processing device 58) is not for example formed by the engine control unit (electronic processing device 16) which is provided in any case, but rather the electronic processing devices 16 and 58 are respective individual components formed separately from one another. It is possible here for the auxiliary control unit (flap control unit) to be easily integrated or interconnected into the existing wiring harness 78, wherein it is furthermore conceivable for additional information items for CAN, LIN etc. to be picked off at a suitable location.

Through the use of the flap control unit, it is possible for an exhaust flap of a series exhaust system to be replaced with the exhaust flap 11 comprising the additional flap control unit, such that, for example, the additional flap control unit simulates removed exhaust flap adjusting components or the removed exhaust flap, also referred to as series exhaust flap and previously installed in place of the exhaust flap 11, in particular for the engine control unit. The electronic processing device 58 replicates, for example, an input interface of the previously installed series exhaust flap and subsequently transmits any fault protocols from its new control component back to the engine control unit. The same applies for adapted position feedback items. For example, not only the fault protocols but also the interface itself are fed back. The engine controller can identify whether the provided component has been installed or whether, for example, a component has been unconnectorged, irrespective of whether a switching valve is actuated or with PWM. Unconnectorging or line breakage is identified and must, at the input of the auxiliary control unit, be implemented in hardware exactly as in the component that replaces the control unit.

It can be seen from FIG. 10 that, by virtue of the fact that the exhaust flap 11 comprises its dedicated electronic processing device 58, the series exhaust flap can be simply replaced with the exhaust flap 11 without the engine control unit (electronic processing device 16) having to be modified or replaced in cumbersome fashion. It can furthermore be seen from FIG. 10 that the exhaust flap 11 comprises for example the actuator 13, which is activatable by means of the flap control unit. It can furthermore be seen that the exhaust flap 11 comprises at least one further valve element which is provided in addition to the valve element 12 and which is movable by means of a further actuator 59. Here, the statements above and below relating to the valve element 12 can readily also be transferred to the further valve element, wherein the statements above and below relating to the actuator 13 can readily also be transferred to the actuator 59, and vice versa.

As in FIG. 9, lines between the digital motor electronics (DME) and the auxiliary control unit may be individual PWM lines or else only one bus line, for example LIN. Similarly the lines between auxiliary control unit 58 and the new exhaust flap adjusters. These lines may also be PWM or LIN as in FIG. 9.

FIG. 10 furthermore shows, in particularly schematic form, a bus system 76 which is formed for example as a CAN bus and/or LIN bus. Via the bus system 76, which is a data bus system, the flap control unit can for example receive data from the engine control unit, wherein the data comprise at least a state of the motor vehicle 1, in particular of the internal combustion engine 3. The flap control unit is now designed to receive at least one first, in particular electrical signal, which is provided by the engine control unit and which characterizes a first position of the valve element 12, to generate at least one second signal, which characterizes at least one second position of the valve element 12 which differs from the first position, as a function of the received first signal, and to transmit the second signal to the actuator 13, in order to thus effect a movement of the valve element 12 into the second position by means of the actuator 13. In particular, the flap control unit is designed to generate the second signal or multiple second signals as a function of the first signal and thus—whilst the flap control unit receives the first signal and whilst the first signal characterizes only the first position—move the valve element 12 by means of the actuator 13 into different positions, in particular in continuous or continuously variable fashion, and hold the valve element in the positions, such that—whilst the flap control unit receives the first signal and whilst the first signal characterizes only the first position—different values of the flow cross section 19 are set and held. Although not illustrated in FIG. 10, reference should also be made here to an additional information item resulting from a separate switch for the after-sales sector. This may indeed also be incorporated directly as hardware into the auxiliary control unit, or by radio or some other location into the bus system.

Figure 11:
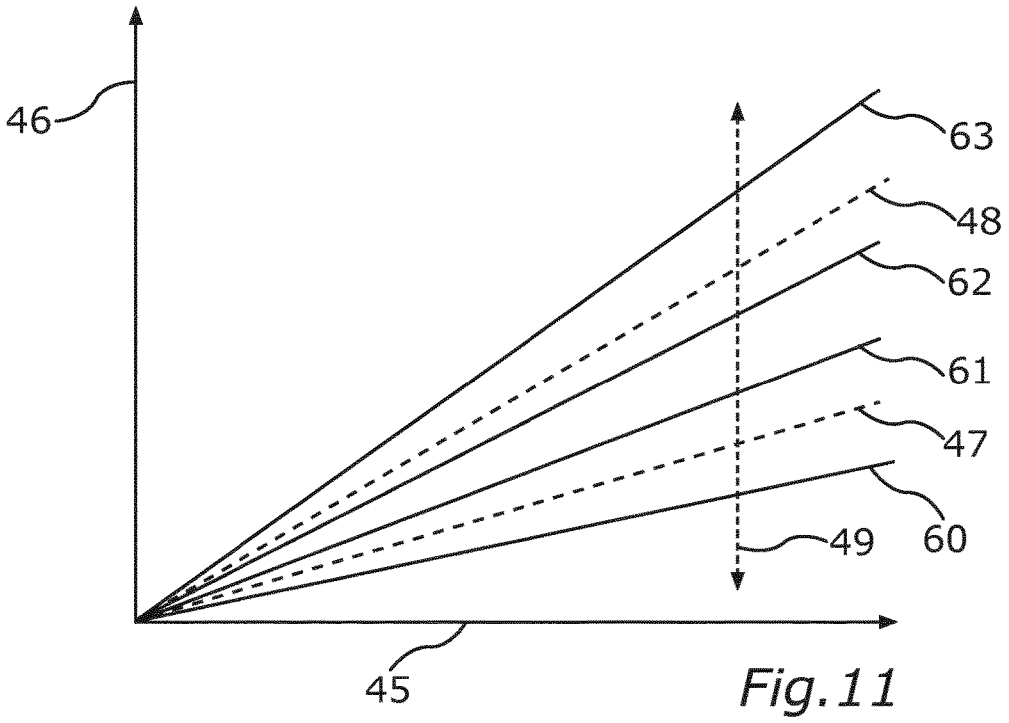
FIG. 11 shows a diagram for illustrating the operation of the exhaust flap according to the invention.

The function of the exhaust flap 11 with the auxiliary control unit will become clear on the basis of FIG. 11. FIG. 11 shows the courses 47 and 48 and further courses 60, 61, 62 and 63 illustrating a respective level curve, which represent for example respective full-load opening levels. The exhaust flap 11 is in this case formed not as a switched exhaust flap but as an exhaust flap which is adjustable, or controllable in closed-loop fashion, over the angle. At a position of the valve element 12 denoted by 0 percent, the valve element is closed, whereby, for example, the flow cross section 19 is reduced to 0. At a position of the valve element 12 denoted by 100 percent, the valve element is open, such that the valve element 12 opens up the flow cross section to a maximum extent. 0 percent thus denotes a first of the end positions, whereas 100 percent denotes the second end position of the valve element 12. Further positions into which the valve element 12 can be moved, and in which the valve element can be held, are situated between the 0% position and the 100% position.

The course 60 illustrates for example the 0% position of the valve element 12, that is to say when the valve element 12 is 0 percent open. The course 47 illustrates for example the valve element 12 which is 10 percent open, whereas, with regard to the series exhaust flap, the valve element 12 is closed in the case of the course 47. The course 61 illustrates for example the valve element 12 which is 20 percent closed, whereas the course 62 illustrates the valve element 12 which is 60 percent closed. The course 48 illustrates the valve element 12 which is 80 percent closed, whereas the course 48, with regard to the series exhaust flap, illustrates the open valve element 12. Furthermore, the course 63 illustrates the valve element 12 which is 100 percent open.

In this idealized case, the retrofit solution then has, in the case of an exhaust flap or valve element angle of 80 percent, approximately the run-up level of the series exhaust system in the case of an open exhaust flap. A similar situation applies to the desired damping. The retrofit solution with an exhaust flap which is 10 percent open is, in the above example, approximately at the level of a series exhaust system with a closed exhaust flap. In the present case, an ideal situation with only slightly modified hardware is presented. In the case of completely different hardware, the level curves of a series open/closed system and of an after-sales closed-loop-control system may also exhibit completely different courses. To be able to replicate the open or closed course of a series exhaust system with an after-sales exhaust system, different angles may be required over the run-up. This may be determined on a test stand and then subsequently controlled in continuous closed-loop fashion by means of characteristic maps.

In a simple exemplary embodiment, the auxiliary control unit requires only the open-closed switching demands provided by the engine control unit, and converts these into corresponding output information items in order to not only simply open and close the valve element 12 but also move the valve element into the abovementioned positions, which differ from the end positions and which are for example situated between the end positions and which are thus also referred to as intermediate positions, and hold the valve element in the positions. This may be realized by means of corresponding corrective characteristic maps. If the level run-up curves differ from one another considerably versus engine speed and load, such a corrective characteristic map may also be implemented in finer form. It is thus possible, for the closed state, for a complete characteristic map versus rotational speed and/or load to be stored, which, depending on the required opening level, can adapt the adjustment angles for the damped output characteristic curve. The same applies to the desired open state. Here, too, it is conceivable for the opening curve to be adapted exactly by means of a corresponding series characteristic map. If such an auxiliary control unit has access to the vehicle CAN, all necessary information items are available, that is to say engine speed, torque, pedal angle, drive modes etc. Even the switching demand of the exhaust flap is available once again in parallel on the CAN.

The engine controller switches the exhaust flaps with corresponding characteristic maps. There are often several of these, for example one for comfort, sport and sport+. In these characteristic maps, for every gear ratio, over particular engine speed ranges, the exhaust flap is opened or closed as a function of the pedal angle. It is thus possible—depending on the characteristic map configuration—to realize, with an auxiliary control unit, a very precise adaptation of the opening level to the series exhaust system. A series exhaust flap application is implemented on the basis of different parameters. During a launch mode, normally comfort, the exhaust flap must initially be closed in the range of the pass-by measurement for approval in most cases. Since, in the comfort mode, a relatively quiet and comfortable vehicle is also desired in any case, many ranges in the lower engine speed/load range are likewise applied to a closed exhaust flap.

By contrast, in the sport modes, the exhaust flap is opened very much more often or earlier. If the bus system 76 is fed, or further information items are fed via the bus system 76, to the auxiliary control unit, then the level adaptation can be performed in an even more exact manner. The information items may for example be information items relating to an engaged gear ratio, the selected drive mode, the pedal angle etc. In the auxiliary control unit, it is then possible, on the basis of these information items and the flap adjustment demand of the series application, for an adapted retrofit exhaust system characteristic map to be stored. As already described above, this may, in the ideal situation, correspond approximately to the level of the series exhaust system. Such an implementation would also have further advantages. Often, the vehicle acoustics in the interior compartment are artificially supplemented. Here, engine orders are played into the interior compartment by the audio system in order to simulate a sporty engine sound. The levels of such artificial supplementation are often based on what level is present in the vehicle, that is to say what is provided by the series exhaust system. The levels of the two systems are thus adapted to one another such that a harmonious acoustic pattern is realized. In engine speed/load ranges in which the series exhaust system exhibits unfavorable acoustics, more can be artificially added and vice versa. Thus, if the opening levels of a retrofit exhaust system are adapted by means of the auxiliary control unit, this has little influence on the series acoustics. This could be advantageous specifically for the base drive modes of comfort, sport and sport+.

That which applies to the level must possibly also be implemented for the exhaust back pressure in certain ranges. If, in future, use will be made of gasoline particle filters and these are to be monitored with regard to exhaust back pressure in very specific engine speed/load ranges, then, in these ranges, it should be ensured that the expected exhaust back pressure is identical to the series configuration, with the acoustics only thereafter being considered. If the acoustics do not lie within the approvable range. Also, a previously customary auxiliary switch for the exhaust flap controller can be implemented by means of the auxiliary control unit. Specifically here, it is then also possible for the potential of a retrofit exhaust system to be utilized again. In an additional characteristic map, the so-called switch characteristic map, it is then possible for the exhaust system to be fully opened at least approximately throughout, if this is desired.

The comfort range, which in almost all drive modes of a series exhaust system can likewise be adapted by means of the flap, can be ignored here. The control unit would—in the case of maximum implementation—correspondingly perform closed-loop control only on the approval-relevant ranges and the range in which possibly the exhaust back pressure must be correct. In some countries, with country coding, a characteristic map variant would also be conceivable which comprises only the ranges of the exhaust back pressure adaptation. If there are countries in which GPFs are used, it would even be possible for this range to be ignored in the case of the switch.

Figure 12:
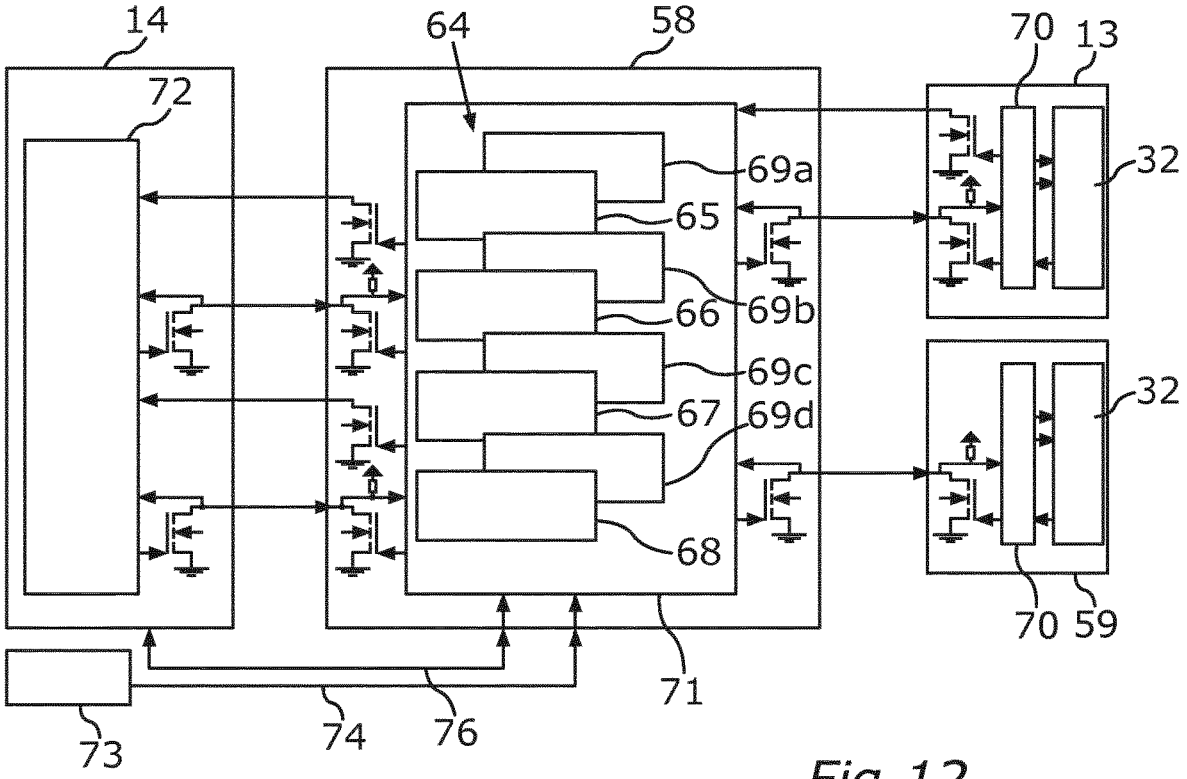
FIG. 12 is a schematic illustration of the electronic processing device of the exhaust flap according to a third embodiment.

The auxiliary control unit (electronic processing device 58) is discussed in more detail on the basis of FIG. 12. For example, adaptation maps 65, 66, 67 and 68 are stored in a memory device 64 of the flap control unit. The adaptation maps 65, 66, 67 and 68 are for example assigned to respective drive modes, wherein the adaptation characteristic map 68 is for example the abovementioned switch characteristic map. Use may furthermore also be made of further adaptation characteristic maps 69*a-d*. Furthermore, respective microcontrollers of the actuators 13 and 59 are denoted by 70 in FIG. 12. The activation of the actuator 13 is realized for example by means of PWM, wherein the activation of the actuator 59 is realized for example via LIN. Furthermore, in FIG. 12, a microcontroller of the flap control unit is denoted by 71, and a microcontroller of the engine control unit is denoted by 72. The abovementioned switch for the operator control or actuation of the exhaust flap 11 is denoted by 73 in FIG. 12, such that the switch 73 is an operator control element for the operator control or actuation of the exhaust flap 11. For example, the operator control element is connected to the electrical processing device 58 via a wireless data connection, in particular a radio connection, such as WLAN, Bluetooth or the like. It is alternatively conceivable for the operator control element to be connected, in particular electrically, to the flap control unit (electronic processing device 58) via at least one physically present line 74.

Altogether, it can be seen from FIG. 12 that, by means of the flap control unit, the abovementioned two valve elements can be moved by means of the actuators 13 and 59. Here, it is not of importance what type of actuator arrangement is used. In particular, it is conceivable for two power outputs to be provided for each adjuster or actuator. The data for the drive modes of comfort, sport and sport+ are stored in the auxiliary control unit, in particular in the adaptation maps 65, 66 and 67. The characteristic maps interpret the specifications from the engine control unit and convert these into corresponding specifications for the respective actuator 13 or 59, which is adjustable over the angle. Both diagnostic information items and position information items are detected by the new adjusters and converted into corresponding protocols for the engine controller. In the case of PWM adjusters, in the event of internally occurring faults, for example if the H bridge is too hot or the stop cannot be reached, etc., the activation line is connected to ground for a certain period of time. The engine controller can identify, and correspondingly interpret, these information items by means of the output stage diagnostics. If the fault protocols of the new closed-loop-controlled adjuster and of the old switched adjuster are identical, then corresponding information items can be transmitted directly through to the engine controller. If the fault protocols however differ, then a corresponding adaptation should be performed. Such an adaptation may likewise be stored in the characteristic maps.

The same applies for the position feedback. If the engine controller expects a position between for example 0 percent for closed and 100 percent for open, then it should also receive such information. If, as in the above example, only 10 percent for closed and 80 percent for open is however implemented by the new closed-loop-controlled adjusters, then this information should not be transmitted in this form to the engine controller, because fault detection would otherwise occur. Here, too, an adaptation is required. For the information feedback to the engine controller, the auxiliary control unit (flap control unit) should for example generate 100 percent from the 0 percent position and from the 80 percent position, and feed this back as a situation or position to the engine controller. This is provided because, otherwise, the diagnostics of the engine controller would assume the presence of a fault. The position feedback will become a topic in future, wherein, specifically for the use of GPFs, a stored exhaust system range should be diagnosable with regard to exhaust back pressure. The position feedback and the adaptation thereof therefore play an important role.

For the retrofit characteristic maps, it may also be important to derive a corresponding situation position of the set drive modes. Irrespective of whether the driver activates the drive mode of comfort, sport or sport+, it is for example possible for the exhaust flap 11 to be operated by means of the switch 73 and thus for example adjusted, in particular closed or open. The background here is that the engine controller does not know that the flap control unit, formed as an external control unit, simulates the flap control. Thus, if implausible position values are fed back here, then a fault report may arise. Here, it is likely to be expedient for the adjustment demand of the corresponding base characteristic map to be directly fed back. This may however possibly become necessary if GPFs (gasoline particle filters) are used in future. In the case of these particle filters, the exhaust back pressure is measured. In order that possible values are obtained here, the exhaust flap control should be reproducible. Data for multiple or different vehicles and exhaust systems in variants may be stored in the flap control unit. These characteristic maps may be codable or programmable by means of the hardware or by means of software. In this way, it would be possible for different exhaust system and vehicle variants to be served by one auxiliary control unit.

Altogether, it can be seen that conventional exhaust flaps can be particularly easily and inexpensively exchanged for the exhaust flap 11 with the flap control unit without the need for the engine control unit to be excessively modified or adapted. In particular, by virtue of the fact that the exhaust flap 11 is formed as a closed-loop-controlled exhaust flap, an exact level adaptation can be realized in respective drive modes, such that compatibility with artificial, internal sound systems can be ensured. In particular, by means of an additional characteristic map (switch characteristic map), the exhaust flap 11 can be implemented with an operator control element such as for example the switch 73, such that, for example, the driver can operate, and in particular adjust or move, the valve element 12 by operating the operator control element.

Altogether, it can be seen that the auxiliary control unit can be switched between the exhaust flap 11 and the engine controller. The auxiliary control unit can simulate the interface hardware expected by the engine controller, and the protocols with regard to signal feedback and/or diagnostics. The base configuration may have all known flap systems, and this may likewise be the case according to the auxiliary control unit. Even a base configuration without adjustable exhaust flaps can be served by a control unit of the type, because all information items relating to the control can be picked off from the data bus. The control unit can, if required, adapt the expected characteristic maps in the basic drive modes in order that they are approximately identical to the series configuration (that is to say for the ranges in which the interaction with active sound for the interior compartment is of importance). The same applies to the approved ranges and/or for the ranges in which the exhaust back pressure must be correct. In the case of an auxiliary switch, it is possible here to focus only on the approved ranges and/or the exhaust back pressure range. By means of variant coding, the characteristic maps may even be varied in a country-specific manner or for different exhaust systems and vehicles. Characteristic maps do not require a large amount of space with regard to memory. The vehicle can then correspondingly switch over depending on vehicle identification and coding.

In other words, the flap or auxiliary control unit makes it possible for after-sales exhaust systems to be retroactively installed and operated on a new vehicle. An after-sales exhaust system commonly has, in relation to a series exhaust system, different opening levels for the flap "open" and "closed" modes. If this opening level were identical to the series exhaust system, then type approval would presumably be possible with the given flap controller. "Identical levels" however also means that such an exhaust system is then no longer significantly different from the series configuration. The reason for the increased difficulty in the design of after-sales exhaust systems is the new pass-by noise regulation R51.03 and the existing exhaust flap controller (in the engine controller for the series exhaust system), which after-sales exhaust system manufacturers normally adopt or utilize. A further problem will be the use of particle filters that will be installed in the case of gasoline engines in the near future. Specifically the different exhaust back pressure and the GPF monitoring. A further topic is the artificial acoustic supplementation in the vehicle by electronic means. An advantage of an after-sales exhaust system has, in the past, been not only the much more pithy pass-by sound but also the possibility of activating the exhaust system independently by means of a separate button or switch. All of these points will no longer be implementable in future with an after-sales exhaust system, at least no longer in the manner implemented previously.

LIST OF REFERENCE CHARACTERS

1 Motor vehicle
2 Rear-end region
3 Internal combustion engine
4 Exhaust system
5 Manifold
6 Body
7 Holding element
8 Rear muffler
9 Tailpipe
10 Surroundings
11 Exhaust flap
12 Valve element
13 Actuator
14 Opening
15 Line
16 Electronic processing device
17 Length region
18 Pipe part
19 Flow cross section
20 Installation bracket
21 Screw preparation
22 Thermal insulation
23 Fastening lug
24 Sleeve
25 Connector
26 Terminal
27 Terminal
28 Terminal
29 Terminal
30 Housing
31 Circuit board
32 Electric motor
33 Rotor
34 Rotor shaft
35 Drive axle
36 Gearing unit
37 Position detecting means
38 Position sensor
39 Series rear muffler
40 Rear muffler housing
40 Exhaust pipe
42 Branch
43 Branch
44 Tailpipe opening
45 Abscissa
46 Ordinate
47 Course
48 Course
49 Double arrow
50 Rear muffler
51 Branch
52 Branch
33 Course
54 Course
55 Exhaust flap
56 Control line
57 Feedback line
58 Electronic processing device
59 Actuator
60 Course
61 Course
62 Course
63 Course
64 Memory device
65 Characteristic map
66 Characteristic map
67 Characteristic map
68 Characteristic map
69*a-d* Characteristic map
70 Microcontroller
71 Microcontroller
72 Microcontroller
73 Switch
74 Line
75 Arrow
76 Bus system
77 Current measuring means
78 Wiring harness
79 Connector The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust flap for an exhaust system of a motor vehicle which has an internal combustion engine and a first electronic processing device for a closed-loop control of the internal combustion engine, comprising:

a valve element;

an actuator, wherein the valve element is movable by the actuator; and a second electronic processing device which is configured to:

receive a first signal which is provided by the first electronic processing device of the motor vehicle, wherein the first signal is a first activation signal to move the valve element to a first position;

generate a second signal, wherein the second signal is a second activation signal to move the valve element to a second position, wherein the second position differs from the first position, as a function of the received first signal; and transmit the second signal to the actuator;

wherein the actuator is configured to receive the transmitted second signal from the second electronic processing device and move the valve element not into the first position of the first activation signal but into the second position of the second activation signal based on the received second signal.

2. The exhaust flap according to claim 1, wherein the valve element is movable in an adjustment range which comprises the second position and a plurality of further positions, wherein the exhaust flap is configured to move the valve element into the positions of the adjustment range and to hold the valve element in the positions of the adjustment range via the second electronic processing device and via the actuator on a basis of receipt of the first signal.

3. The exhaust flap according to claim 2, wherein the exhaust flap is configured to move the valve element into respective positions of the adjustment range and to hold the valve element in the respective positions via the second electronic processing device and via the actuator in a continuously variable fashion.

4. The exhaust flap according to claim 1, wherein the second electronic processing device is configured to:

receive data which are provided by the first electronic processing device of the motor vehicle and which characterize a state of the motor vehicle; and generate the second signal as a function of the received data.

5. The exhaust flap according to claim 4, wherein the state comprises a rotational speed of the internal combustion engine and/or a torque of the internal combustion engine and/or a mass flow of an exhaust gas provided by the internal combustion engine and/or a position of an accelerator pedal of the motor vehicle and/or a set drive mode of the motor vehicle and/or a state of an operator control element which is actuatable by a person and which serves for operator control of the exhaust flap.

6. The exhaust flap according to claim 1, wherein the second electronic processing device has a memory device that stores a characteristic map which includes the second position and multiple positions which differ from one another and from the second position, wherein the second electronic processing device is configured to select one of the positions of the characteristic map from the characteristic map and to effect a movement of the valve element into the selected position by the actuator as a function of the received first signal.

7. The exhaust flap according to claim 1, wherein the second electronic processing device is configured to:

receive data which are provided by the first electronic processing device of the motor vehicle and which characterize a state of the motor vehicle; and generate the second signal as a function of the received data;

wherein the second electronic processing device has a memory device that stores a characteristic map which includes the second position and multiple positions which differ from one another and from the second position, wherein the second electronic processing device is configured to select one of the positions of the characteristic map from the characteristic map and to effect a movement of the valve element into the selected position by the actuator as a function of the received data.

8. The exhaust flap according to claim 1, wherein the actuator is an electrically operable actuator.

9. The exhaust flap according to claim 1, wherein the exhaust flap is configured to:

detect at least the second position;

generate a feedback signal which characterizes the first position as a function of the detection of the second position; and provide the feedback signal to the first electronic processing device of the motor vehicle by the second electronic processing device.

10. An apparatus for an exhaust flap which has a valve element and an actuator via which the valve element is movable of an exhaust system of a motor vehicle, wherein the motor vehicle has a first electronic processing device, comprising:

a second electronic processing device, wherein the second electronic processing device is configured to:

receive a first signal which is provided by the first electronic processing device of the motor vehicle, wherein the first signal is a first activation signal to move the valve element to a first position;

generate a second signal, wherein the second signal is a second activation signal to move the valve element to a second position, wherein the second position differs from the first position, as a function of the received first signal; and transmit the second signal to the actuator;

wherein the actuator is configured to receive the transmitted second signal from the second electronic processing device and move the valve element not into the first position of the first activation signal but into the second position of the second activation signal based on the received second signal.

11. A method for operating an exhaust flap of an exhaust system of a motor vehicle which has an internal combustion engine and a first electronic processing device for a closed-loop control of the internal combustion engine, wherein the exhaust flap has a valve element and an actuator via which the valve element is movable, comprising the acts of:

receiving a first signal by a second electronic processing device from the first electronic processing device of the motor vehicle, wherein the first signal is a first activation signal to move the valve element to a first position;

generating a second signal, wherein the second signal is a second activation signal to move the valve element to a second position, wherein the second position differs from the first position, as a function of the received first signal;

transmitting the second signal to the actuator;

receiving the transmitted second signal by the actuator; and moving the valve element not into the first position of the first activation signal but into the second position of the second activation signal by the actuator based on the received second signal.

* * * * *